US006191350B1

(12) United States Patent
Okulov et al.

(10) Patent No.: US 6,191,350 B1
(45) Date of Patent: Feb. 20, 2001

(54) ELECTRONIC STRINGED MUSICAL INSTRUMENT

(75) Inventors: Paul Okulov, Montreal; Ubaldo Fasano, deceased, late of Montreal, by France Fasano, legal represenative; Jean-Pierre Paradis, Montreal, all of (CA)

(73) Assignee: The Guitron Corporation, Verdun (CA)

( * ) Notice: Under 35 U.S.C. 154(b), the term of this patent shall be extended for 0 days.

(21) Appl. No.: 09/496,040

(22) Filed: Feb. 2, 2000

Related U.S. Application Data

(60) Provisional application No. 60/118,525, filed on Feb. 2, 1999.

(51) Int. Cl.[7] ..... G10H 1/18

(52) U.S. Cl. ..... 84/646; 84/723; 84/731; 84/738

(58) Field of Search ..... 84/600–606, 646, 84/723–726, 730–731, 737–738, DIG. 24

(56) References Cited

U.S. PATENT DOCUMENTS

| | | | | |
|---|---|---|---|---|
| 3,956,962 | | 5/1976 | Fields | 84/267 |
| 4,408,516 | * | 10/1983 | John | 84/275 |
| 4,630,520 | | 12/1986 | Bonanno | 84/655 |
| 4,635,518 | | 1/1987 | Meno | 84/722 |
| 4,760,767 | | 8/1988 | Tsurubuchi | 84/DIG. 30 |
| 5,005,461 | * | 4/1991 | Murata | 84/646 |
| 5,033,351 | | 7/1991 | Nomura | 84/646 |
| 5,040,447 | * | 8/1991 | Murata et al. | 84/723 |
| 5,121,668 | | 6/1992 | Segan et al. | 84/646 |
| 5,121,669 | * | 6/1992 | Iba et al. | 84/737 |
| 5,286,911 | * | 2/1994 | Murata et al. | 84/723 |
| 5,380,948 | | 1/1995 | Freimuth et al. | 84/320 |
| 5,396,828 | | 3/1995 | Farrand | 84/462 |
| 5,398,585 | | 3/1995 | Starr | 84/646 |
| 5,619,003 | | 4/1997 | Hotz | 84/615 |

FOREIGN PATENT DOCUMENTS

| | | | |
|---|---|---|---|
| 0339575A2 | 11/1989 | (EP) | G10H/1/38 |
| WO 93/02438 | 2/1993 | (WO) | G09B/15/00 |

* cited by examiner

*Primary Examiner*—Robert E. Nappi
*Assistant Examiner*—Marlon Fletcher
(74) *Attorney, Agent, or Firm*—Paul S. Sharpe; Marks & Clerk

(57) ABSTRACT

A guitar is disclosed which is adapted for use with a battery power source and having a CPU and a memory including preprogrammed chord tables and melody tables. The guitar provides electro conductive strings and frets and a system for recognizing finger positioning by a user. The vibration of the strings is picked up by piezo elements and amplified. By making use of the piezo elements the intensity of the vibration by its velocity can be preserved and the envelope of sound for a note/chord remain commensurate with the intensity intended by the user.

30 Claims, 15 Drawing Sheets

10'
108'
104'
114'
30
102'
106'
100'
12
20
22

108'
30
26
68
112'
110'
20
12
22

108'
30

ELECTRONIC STRINGED MUSICAL INSTRUMENT

This application claims the benefit of U.S. Provisional application Ser. No. 60/118,525 filed on Feb. 2, 1999.

FIELD OF THE INVENTION

The present invention relates to musical stringed instruments, and more particularly the present invention relates to those able to play chords and more specifically guitars. This invention can also be associated with MIDI input devices and in addition relates to the methods of operating a guitar controller for an electronic music synthesizer.

BACKGROUND OF THE INVENTION

The fret board of a guitar, for example, is normally used as a some sort of switching device and the strings are used as triggers for initiating specific notes or groups of notes in accordance with the fingerboard switches. The instrument may have on board electronic micro processing unit/s, a scanning device for fingerboard switches and synthesizer and/or MIDI compatible output. Some devices include an internal amplifier and a speaker that allows one to play the instrument without an external audio system.

Other devices allow the player to create chords by simply plucking and strumming allocated string and pressing the fret as set forth in U.S. Pat. No. 5,121,668, issued to Segan et al., Jun. 16, 1992. Such devices, although useful, cannot produce natural sounding chords, when played in the desired sequence of the strings, or strummed or finger picked.

In order to reduce the loudness of the sound of the strings when used as a triggering device, many of the existing designs employ mechanical means for string damping made in a form of soft rubberlike foams or gel contacting strings directly near the bridge. A typical arrangement is discussed in U.S. Pat. No. 3,956,962, issued to Fields, May 18, 1976. These dampers can significantly reduce the audio output of the vibrating string. The disadvantage of such devices is that having mechanically damped the string, its normal oscillations are distorted and have to be recreated by the electronic means for producing appropriate pitches.

The wired fret concept for creating a switching fingerboard is also well known from the prior art. In U.S. Pat. No. 4,635,518, issued to Meno, Jan. 13, 1987, having segmented frets with resistors installed between the frets along the string with strings used as ground wires is disclosed. There also are designs employing resistive strings and frets scanned in a specific manner that allow the determination of an exact position of the finger on the fingerboard, and the operation of an electronic micro processor.

U.S. Pat. No. 5,398,585, issued to Starr, Mar. 21, 1995, provides a guitar having a switch placed along the neck. In other cases, the switches are placed beneath the strings, so when the string is depressed the switch goes on such as that described in U.S. Pat. No. 5,033,351, issued to Nomura, Jul. 23, 1991. Some switches change their resistance under the pressure of the finger in order to emulate different velocities of the MIDI signal or the variation of other parameters. These concepts are set forth in U.S. '585.

The use of switches creates difficulties in playing the guitar, especially applying bar chords. Further, these instruments cannot be played as a normal acoustic or electric guitar.

One of the earliest attempts to create a simple fingering device for chord creation was the Guitarola. This included a mechanical device attachable to a guitar neck above the strings. Using just one finger, the player could create a variety of chords predetermined by the design. This device was generally difficult to use and it offered a limited number of chords. In addition, the guitar required tuning on a regular basis.

There are also devices known from the prior art which provide an audio signal by means of internal speakers. In view of the limited space and weight considerations for these devices, speaker quality normally is severely compromised with concomitant degraded sound quality.

Also well known are electro-acoustic guitars which allow one to play in a normal acoustic mode or with an external amplifier-speaker system. These guitars do not offer electronic chord creation by fret depression means for reproducing a sound in the electronic mode.

The present invention addresses all of these issues and provides for a significantly improved device.

SUMMARY OF THE INVENTION

It is an object of one embodiment of the present invention to provide a playable, high quality and self-contained acoustic guitar able to produce, in its electronic mode, a wide variety of chords by simply depressing frets by one or more fingers.

According to one embodiment of the present invention, the guitar feels and looks like an ordinary acoustic or electric solid body guitar. It has a wooden body and strings, and, in fact, can be played normally by a guitar player. Advantageously, anyone without previous guitar playing experience or training, can play chords and melodies. The sounds have been sampled from some of the very finest instruments available and are reproduced with the latest sample playback technology.

Selecting one chord after another from a wide palette of choices is straight forward. A display along the fingerboard indicates chord roots, and a display in the sound hole indicates specific chords selected.

In terms of the sampled sounds, an acoustic 1977 LoPrinzi custom dreadnaught steel string flattop, an 1867 Martin New Yorker parlor guitar, a Fender Stratocaster, a Fender Telecaster, a 1937 Gibson Charlie, Christian, a Gibson Heritage Les Paul, and a Gibson ES 335 were sampled.

Advantageously, a low cost self-contained musical stringed instrument able to create chords, melody, or sequences of played back notes by pressing one or more fingers on the fingerboard is realized by the present invention.

It is still another object of the present invention to provide a MIDI controller in the form of a stringed instrument, for example, a guitar.

It is still another object of the invention to eliminate need for a speaker inside the acoustic guitar body.

Another feature of the invention provides for an electronic musical instrument which will be visually and sonically undetectably similar to a high quality acoustic instrument in terms of its "forgiveness" to the player.

One object of one embodiment of the present invention is to provide a musical instrument, comprising:

an instrument body having strings mounted thereon;

string vibration sensing means for sensing vibration of the strings;

a central processing unit;

an elongate fingerboard having a finger position recognition system for recognizing finger position;

memory means for storing preprogrammed notes and chords;

output means for transmitting vibration information from the memory means; and circuit means connected to the output means, the string vibration sensing means, the central processing unit, the finger recognition system and the memory means for determining the envelope of vibration of the strings whereby note or chord intensity intended by a user is conveyed to the transducer means.

Additional features of the invention include a neck display which will indicate the position of a chord played or melody note, nut display which will indicate a string with the chord root and an additional display in the sound hole for the indication of the chord presently played and other information like current mode of use, status of the system, and the result of self-diagnostic tests.

As a convenience, the instrument according to the present invention has the capability of generating chord sequences using a chord table consisting of basic triad chords and a chord map modifying these chords into other guitar chords. Slash chords may be played by simply depressing a root chord and a bass note to be played.

The arrangement discussed herein allows play in several modes including the capo mode, melody mode, chord mode, melody and chord mode.

A further object of one embodiment of the present invention is to provide a guitar, comprising:

a guitar having a body and fret board;

a plurality of electro conductive frets mounted to the fret board;

a plurality of electro conductive strings;

a string vibration sensing means for sensing vibration of the strings;

a central processing unit and memory means for storing preprogrammed chords and/or notes;

output means including a soundboard with at least one piezo electric activator means secured thereto;

circuit means connected to the string vibration sensing means, frets, the strings, means for determining the position of user's finger on the fret board and accessing the memory means for a preprogrammed note or chord; and analyzing means for determining an envelope of vibration of the strings whereby note intensity and chord's note sequence intended by a user is conveyed to the output means by playing notes from the memory means.

In terms of other features, it is possible to mechanically separate the bridge from the acoustic guitar sound board with the possibility of bringing it back into contact with the sound board. It is also desirable that when the bridge is separated from the sound boards, the strings are lifted in order to provide higher action and its tension is simultaneously lowered.

The invention provides the user for instance with a diatonic scale where pressing one fret creates a diatonic note (C, D, E, F, G, A, B, etc.) and pressing the two frets creates an accidental note. As an example, pressing C and D will create C♯ or Db. As an additional feature it can only provide pressure sensitive pad/s (for example pick guard pad) which will produce specific signal/s upon touch by the finger or with a pick and will change specific parameters or settings of the electronic instrument (like vibrato, pitch bending, etc.).

It is an object of the present invention to provide a split between strings or frets or both which will be used for playing melody and playing chords. For example, certain strings can be dedicated solo strings and the rest of the strings will be used for chord playing.

As a further convenience, the invention may be used as a self contained musical instrument as well as in combination with head phones, external amplifier and/or speaker, external MIDI device and/or synthesizer, computer, etc.

A still further object of one embodiment of the present invention is to provide a method of electronically generating sound from a guitar, comprising the steps of:

providing a guitar including:

signal pick ups and a fret board;

memory means having sampled chords, notes or a chord map;

electro conductive strings and frets on the guitar;

finger position recognition means for recognizing finger positioning on the fret board;

analyzing string vibration for string velocity, status and sequence of notes played;

comparing the notes played with notes in the memory means;

determining the status and velocity of the strings;

forming a signal based on determined velocity and compared notes;

transmitting the signal to an output for audible execution of the signal.

In one embodiment, the device consists of an acoustic or solid guitar body, the neck with a fingerboard, nut and frets, the machine head, the strings, and a bridge. Generally speaking electro conductive vibes-frets comprise a device for the determination of finger position. Frets and strings are made of electro conductive material and together possess a matrix of switches. Along the neck the LCD displays or any other type of displaying device are placed near each fret so the user can easily associate an appropriate fret to be depressed. Optionally, the device may include a display mounted inside the acoustic guitar body below the sound board and inside the sound hole allowing visiblity through the sound hole. The instrument has a rechargeable battery and power supply, control panel with an on-off switch, volume, treble, pitch control knob, and bass control knobs, the external power supply and recharging socket, MIDI In and MIDI Out sockets, the audio output line and head phones socket.

In a preferred embodiment, the sound board has one or several piezo actuators discreetly inside the guitar body. These piezo elements are attached to the soundboard and electrically connected to each other in parallel or in another desirable order, and their polarity is chosen in such a way that they provide desirable bending of the sound board when the electrical current is applied.

It is an option that the bridge or its middle portion with the strings' saddle and anchors be mechanically connected to the internal tail piece, directly connected to the rear portion of the guitar and more precisely to the rear block. This element has a mechanical device which can bring the bridge and saddle into contact with the sound board or to mechanically separate them from each other.

In greater detail, the piezo saddle has a number of (five for a six string guitar for instance) slots separating portions (segments) of the saddle for each string. Each of these portions of the saddle have piezo elements sensitive to the mechanical bending or compression of the saddle segments and are preferably compressed under the action of the string tension. Each of these piezo elements are connected to a distinct amplifier and rectifier with a filter for the frequencies out of the string's normal oscillation range. The output of this system is fed to the logical triggering device which is preset to the specific amplitude of the signal to produce an "On" signal passed further to the CPU to produce a distinct note or a note belonging to a distinct MIDI channel associated with that string.

All chords and single notes are stored in several tables corresponding to the specific mode of the use (melody, chord, capo, etc.). The instruction of which chord or note to play comes from the fingerboard depending on the specific fingering and selected mode. Chords and notes are memorized in such a way that upon plucking a specific string, an allocated note from the chord or note table is sent to the synthesizer to produce that note. The velocity of the note played depends on the current or initial velocity of the particular string plucked or strummed. Velocity split may be employed to create a more natural sound, like buzzes, etc.

A further option that an envelope of the note synthesized is shaped by the actual output from the corresponding and naturally oscillating string which makes available all possible manipulations with the string (like muting, specific plucking techniques, etc.) fully reflected by the CPU or a MIDI system and synthesizer.

Chord tables contain different voicings depending on the position of the capo and the musical scale chosen.

The immediate content of the chord table or note table is released upon the specific string trigger and it turns ON. This instruction, along with information about initial/current velocity of the signal is then being passed to the synthesizer which has a variety of memorized notes allocated to the instrument chosen to play. Examples include a nylon string classical guitar, jazz guitar, electric guitar, etc. The output of the synthesizer is connected to an internal amplifier which is able to produce a high voltage (100–130 Volts for instance). The output is then directed to the piezo actuators. It is an option that an output transformer could be used in order to get higher voltage or a high voltage audio amplifier.

The neck display may be solid state or consist of LCDs placed on its side and directed toward the player. Each display can have an alpha-numerical character to specify the note or the chord root played, a "♯"-sharp sign and a "b" -flat sign and some specific character/s to indicate other conditions (for instance). This display is confirming the scale that was chosen and the capo position. The display may be LCD, LDE, electro-luminescent or any other suitable type. The electronic unit of the device consists of one or several microprocessors which are able to scan the fret board switching device and decode the combination of fingers versus frets pressed and allocate specific chords or notes to be played from the tables. Another function of the microprocessor is to operate the displays through the appropriate drivers, analyze the output of the string triggers, control and optimize the power consumption of the unit, run self-diagnostic tests, etc.

A synthesizer is provided and has a memory where all notes related to chosen instruments, voicings for different modes are stored, and other devices needed to produce envelopes of the pitches. The synthesizer may comprise for instance a CPU and a standard codic soundport.

The device may also include a nut display showing the root string in a chord played and a sound hole display for the indication of current chord or note played and other functional information.

Ancillary advantages ascribable to one embodiment of the present invention, include:

a) play as either an acoustic guitar or an electronic guitar;

b) high-quality sounds;

c) the inclusion of an extensive library of rich voicings, which is easily accessible; and d) a capo feature having twice the ordinary range, while remaining easy to play.

Generally, the device includes a computer program created first as a high-level simulation and later ported to an embedded-system. A typical selection of chord voicings played by guitarists were analyzed and devised as a system whereby voicing choices and voice leading are automated as a guitar player might play, but with the most rudimentary indication by the player. This provides the guitar with a very guitar-like musical movement from chord-to-chord without any special effort, experience, or understanding.

This arrangement is in contrast with the prior art which consisted of, for the most part, mechanical assemblies that fit over physical string arrays. Such arrays were limited by the physical arrangement of mechanical levers and buttons. The guitar in accordance with the present invention has no such limitation; it allows mapping of decoded fingerings in a completely abstract and novel way.

Having thus described the invention, reference will now be made to the accompanying drawings illustrating preferred embodiments.

BRIEF DESCRIPTION OF THE DRAWINGS

Similar numerals in the figures denote similar elements.

DETAILED DESCRIPTION OF THE PREFERRED EMBODIMENTS

Figure 1:
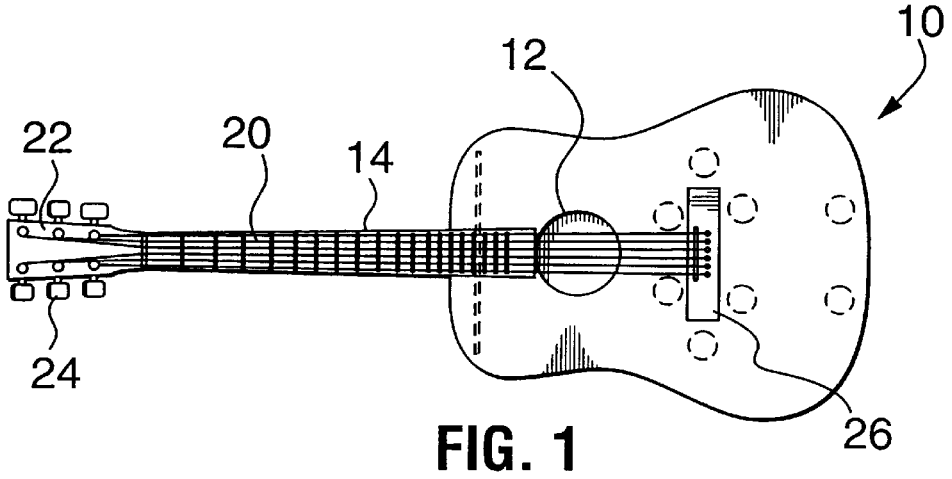
FIG. 1 illustrates one embodiment of the present invention in a form of acoustic guitar.
Figure 2:
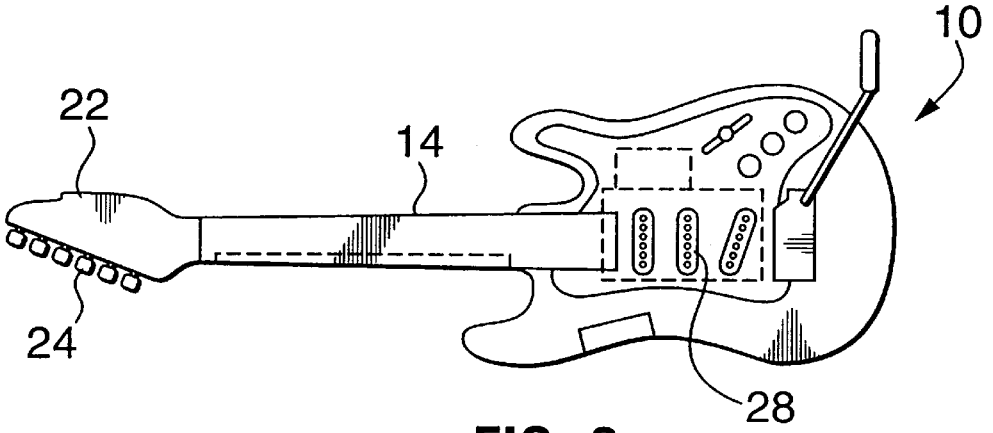
FIG. 2 illustrates the present invention in a form of a solid body guitar.
Figure 3:
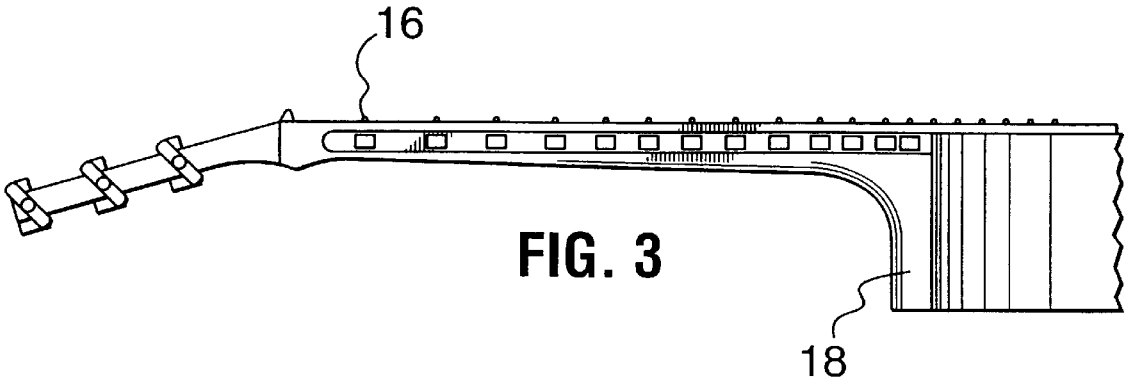
FIG. 3 shows a partially cut away side view of FIG. 1.

Referring now to the figures, a typical guitar is shown in FIG. 1 having a body 10, sound hole 12, fingerboard 14, frets 16, neck 18 (FIG. 3), strings 20, head 22 and tuning pegs 24. The strings 20 terminate at bridge 26. An electric version of the guitar 10 is shown in FIG. 2, where the sound hole is replaced by pick ups 28 as is know in the art.

Figure 5:
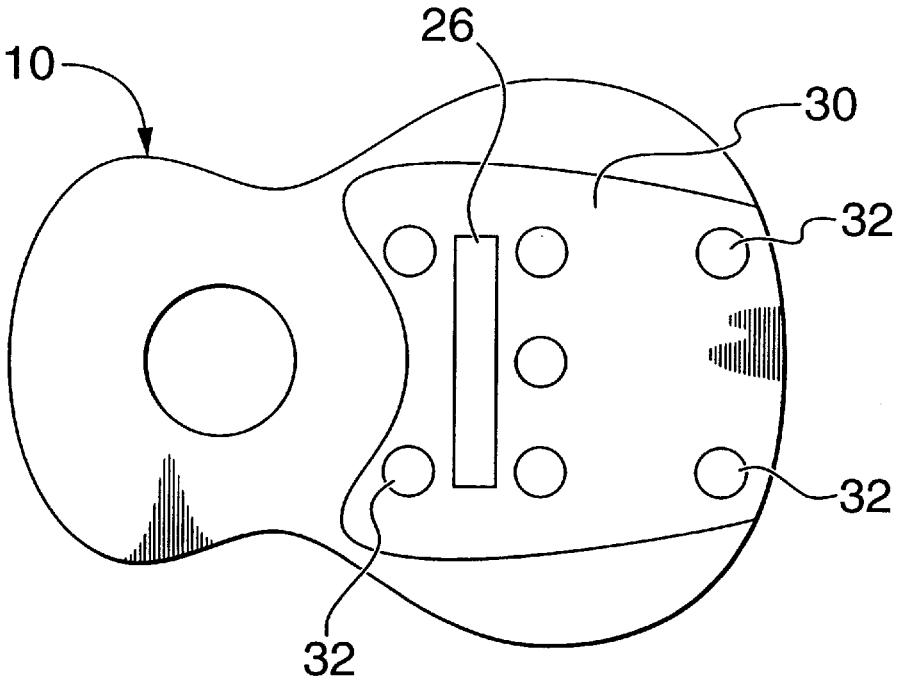
FIG. 5 illustrates a mapping of the soundboard with respect to different frequencies produced.
Figure 6:
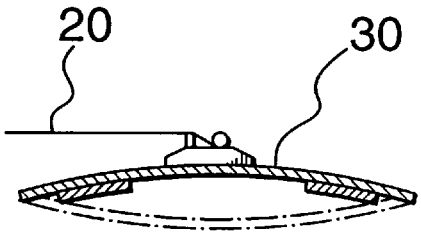
FIG. 6 and FIG. 7 illustrate soundboard vibrations produced by piezo actuators.
Figure 7:
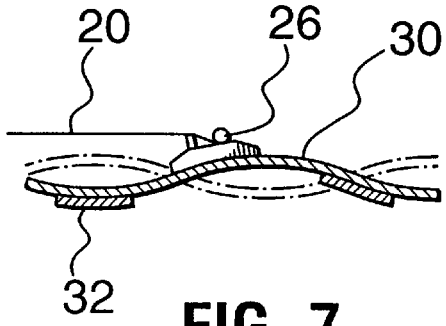
Figure 8:
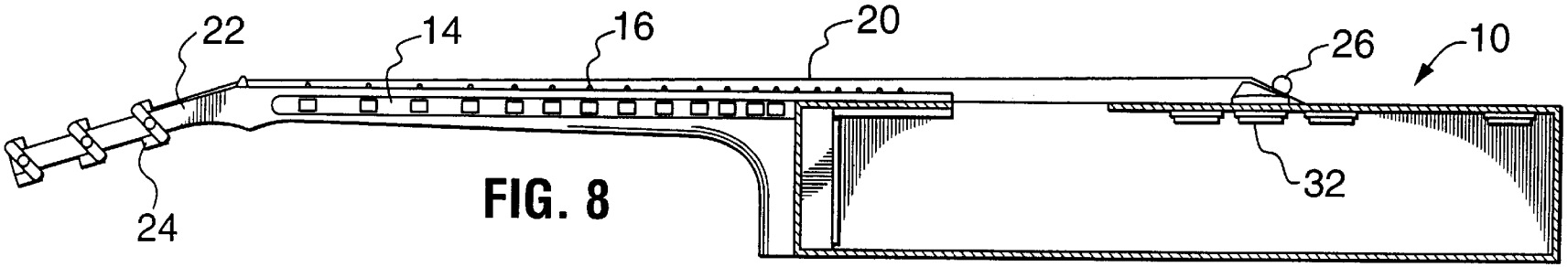
FIG. 8 illustrates a cross section of the preferred embodiment with piezo elements attached to a sound board.
Figure 8A:
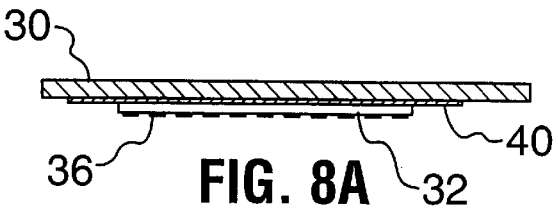
FIG. 8*a* is an enlarged illustration of the device of FIG. 8.

The bridge 26 is connected to the sound board 30, shown in FIG. 5. The figure illustrates the sound hole wall of the guitar 10 with parts removed for clarity. Generally speaking, the string vibration is transmitted through the bridge 26 with sound production at sound board 30. In the embodiment shown, a series of piezo actuators 32 fixed to the sound board 30 impart stress to the sound board 30 thereby causing the latter to bend and produce sound. Deflection of the sound board is shown in FIGS. 6 and 7. The mounting of the piezo actuators is illustrated in FIG. 8 and enlarged in FIG. 8*a*. The piezos, of which only one is shown in FIG. 8*a* , each include an electrode 36 (dashed line) mounted to a metal plate 40 which, in turn, is fixed to the sound board 30.

Figure 14:
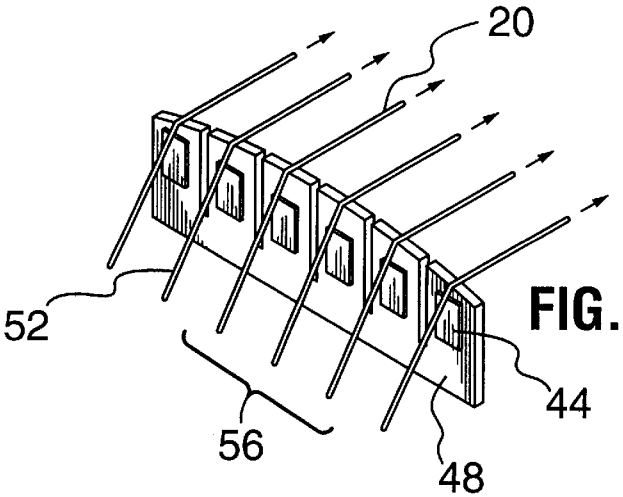
FIG. 14 illustrates a design of piezo saddle.
Figure 15:
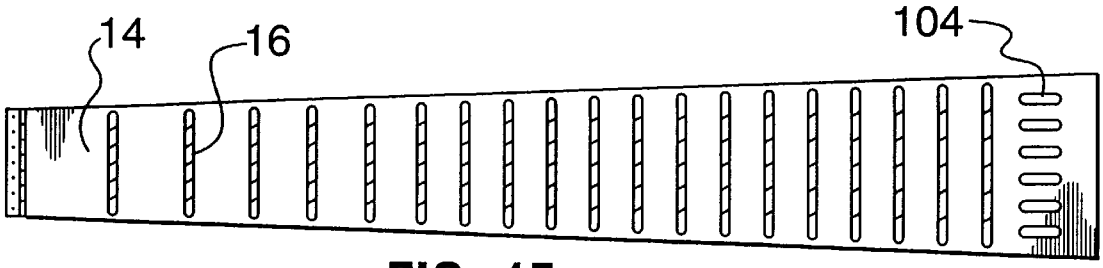
FIG. 15 illustrates a molded fingerboard with segmented frets and windows for neck displays.
Figure 16:
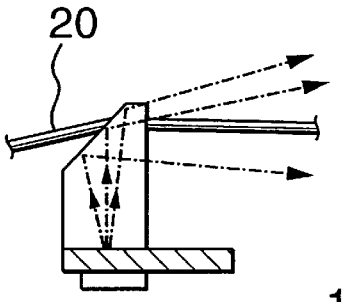
FIG. 16 illustrates a detailed look of the transparent nut and LEDs comprising a nut display.

With reference to FIG. 14, the piezo actuators 32 receive vibration signals from strings 20, the signals being transmitted by piezo elements 44 connected to saddle 48.

It is possible to employ any of the known guitar pick ups including magnetic, optical or piezo, etc. In the present invention, it is preferable to use the piezo pick up saddle 48 made in the form of a flat flexible PCB with at least one electro conductive-layer such as copper. Slots 52 in saddle 48 separate it into segments 56 associated with each string 20. On each segment 56, preferably compressed by the action of the string tension, separate piezo elements 44 are attached to it. The vibration of the string creates variations of the string tension and an according variation of the bending moment in the PCB segment with piezo element 44. Thus, the electrical signal in the piezo elements 44 is produced. In this manner, the piezo actuators 32 receive electrical signals from elements 44 and induce flexure of the sound board 30. Amplification of the signals will be discussed hereinafter.

Figure 22:
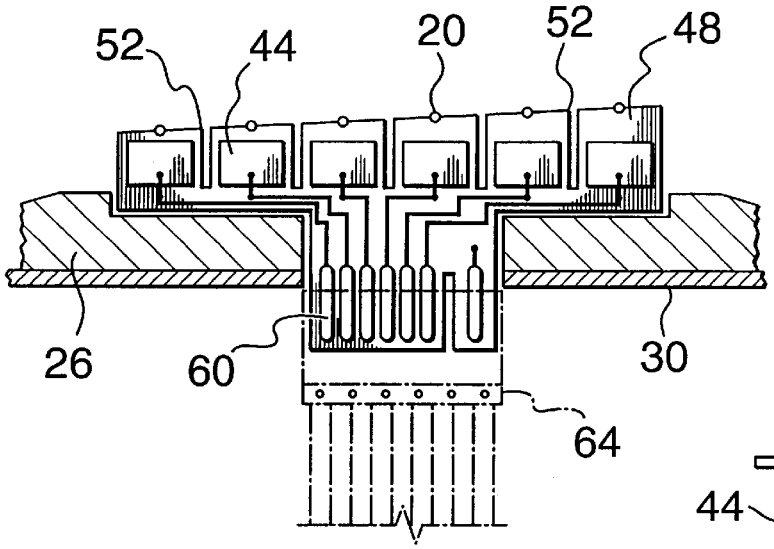
FIG. 22 illustrates a piezo saddle with independent channels for each string in more detail.
Figure 23:
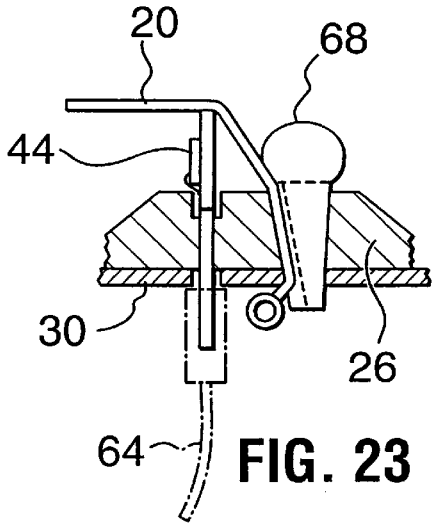
FIG. 23 is a cross section of FIG. 22.

FIGS. 22 and 23 more clearly illustrate the relationship between the strings 20, piezo elements 44 and sound board 30. Circuit connections 60 electrically connect the piezo elements 44 to a ribbon cable 64 discussed herein after. As illustrated, strings 20 are tensioned over the PCB saddle 48 and terminate in a conventional plug or pin 68 frictionally retained in bridge 26.

Figure 24:
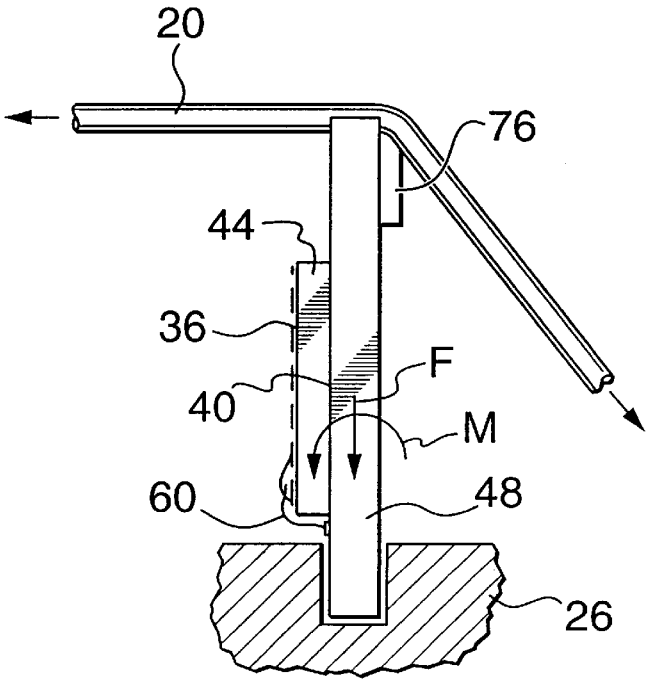
FIG. 24 is an enlarged view of FIG. 23.
Figure 25:
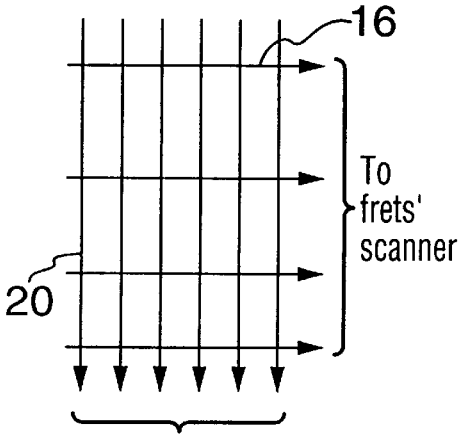
FIGS. 25 through 30, illustrate schematic illustrations of the fingerboard switching devices associated with the wired fret concept.
Figure 26:
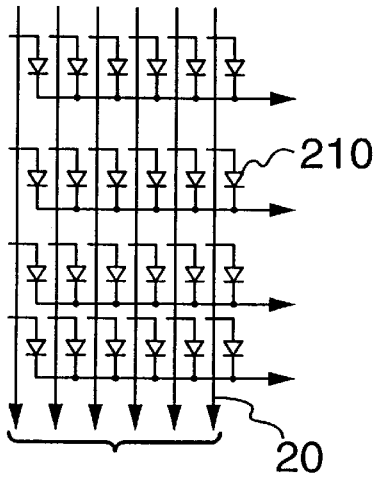

FIG. 24 illustrates an enlarged view of the saddle 48 and string 20 tensioned on the saddle 48 and includes a string contact 76 positioned for contact with string 20.

Figure 13:
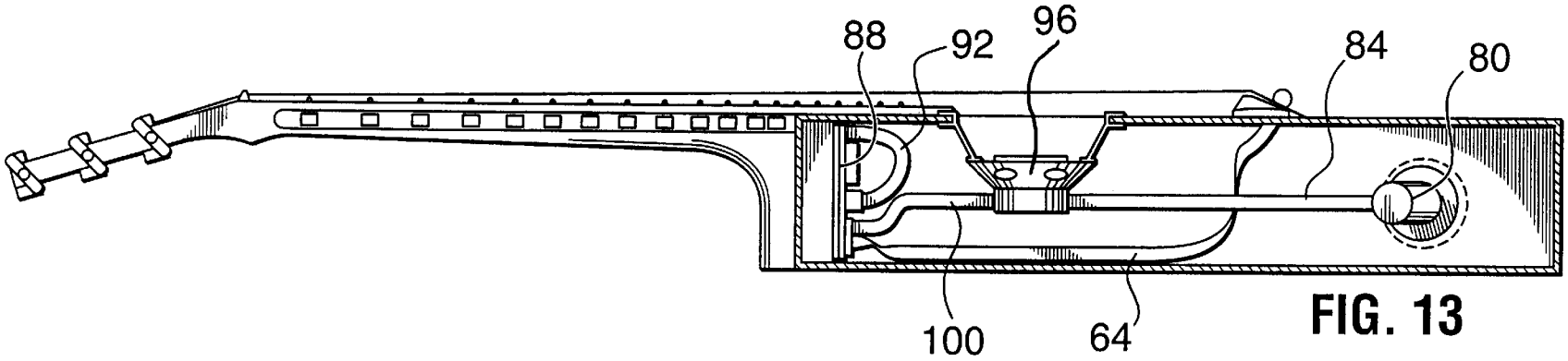
FIG. 13 illustrates a cross section of the device with an internal speaker obstructing the sound hole.

FIG. 13 illustrates a longitudinal section of the guitar according to one example. A source of power denoted by numeral 80 is provided in the body 10 of the guitar. The source is a battery system which may be rechargeable to supply power to the components of the guitar. Any of the suitable arrangements well known in the battery art may be used. A cable 84 extends from the power source 80 to supply power to the main board 88 mounted within the body 10 as shown. A second cable 64, discussed previously, extends from saddle 48 to main board 88, while a third cable extends from fingerboard 14 to main board 88. A speaker 96 is shown positioned adjacent sound hole 12 and functions as a transducer for generated sound as one possibility. Electrical communication between speaker 96 and main board 88 is achieved by cable 100.

Figure 17:
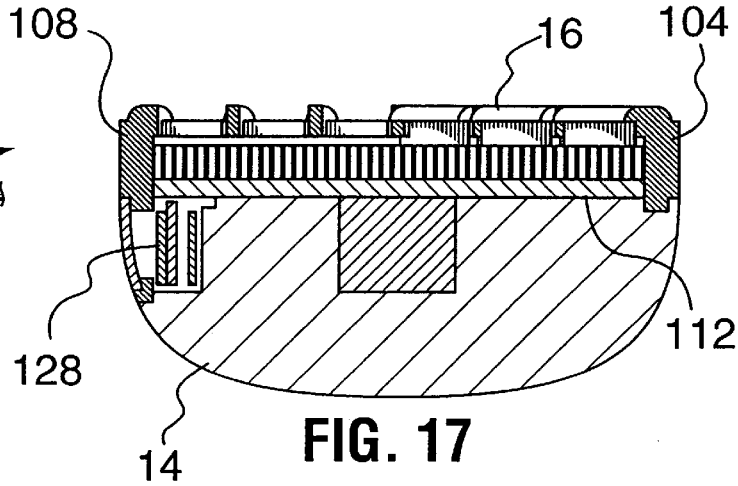
FIG. 17 illustrates a cress section of the neck with molded fingerboard and PCB with components.
Figure 18:
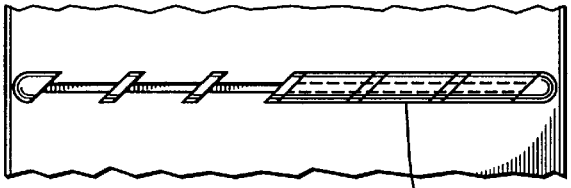
FIG. 18 is a longitudinal cross section of the fingerboard of FIG. 17.

Returning to the fingerboard 14, the same provides a plurality of selector switches for selecting a chord or note. A cross section of the fingerboard 14 is shown in FIG. 17, where electro conductive rubber members 104 and 108 flank the arrangement of frets 16. FIG. 18 illustrates in greater detail the fret system. A PCB 112 underlies the frets 16 and includes electrical components 116 for interpretation/transmission of signals received from the frets 16. Connection between the individual frets 16 and PCB 112 is facilitated by electrical connectors 120.

Figure 18A:
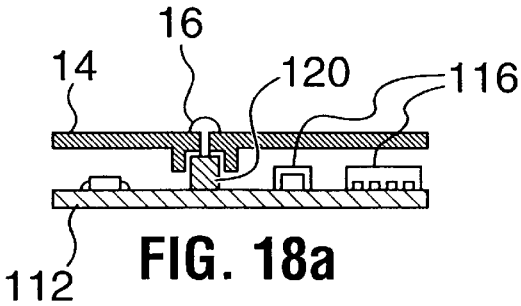
FIG. 18*a* is a cross section of FIG. 18 with parts removed.

The frets may be continuous or segmented as illustrated in FIGS. 18 and 18*a*, and represented by numeral 124. In order to convey what note/chord is being selected, a visual display 128 is mounted adjacent fingerboard 14, also shown in FIG. 19. The display 124 in the example is an LCD display.

Figure 19:
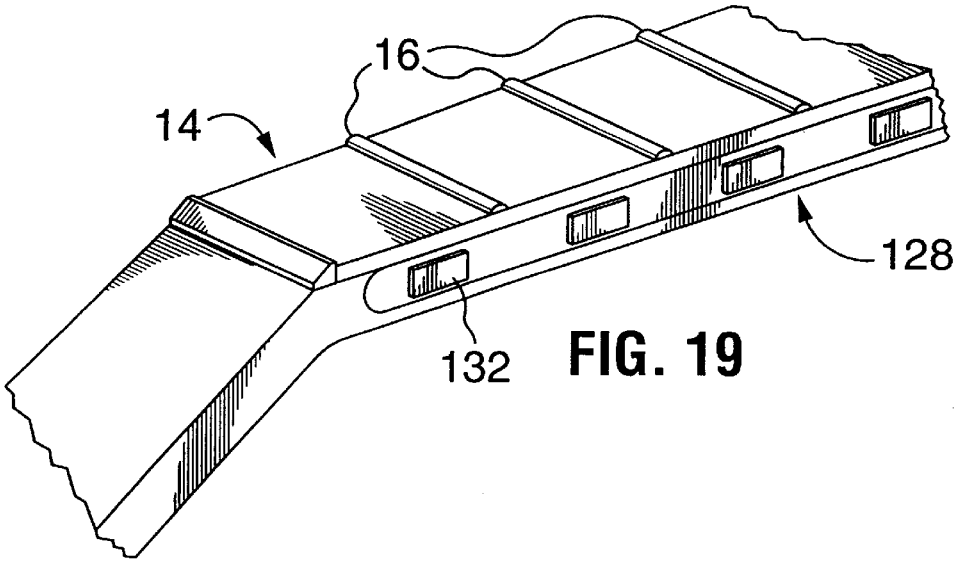
FIGS. 19–21 illustrates a general design of the neck and fingerboard with wired frets.
Figure 20:
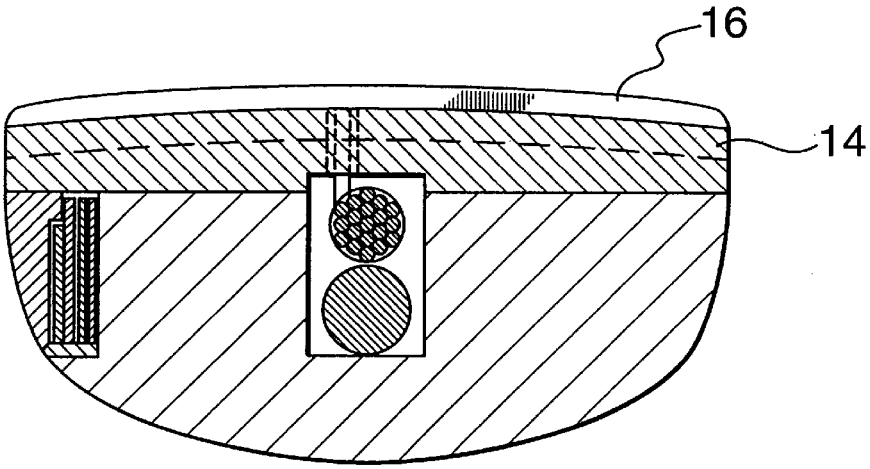
Figure 21:
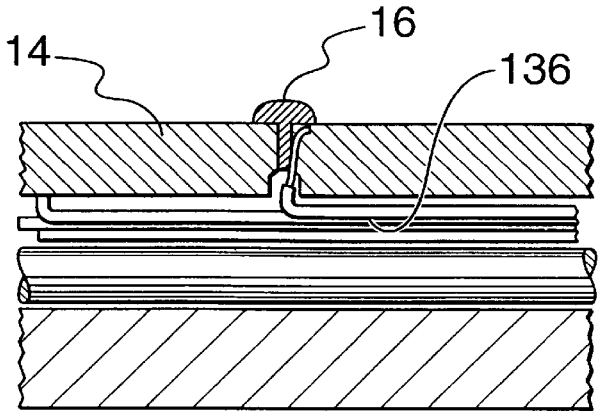

Turning to FIGS. 19 through 21, the display 128 includes a series of individual windows 132 adjacent the frets 16 down the length of the fingerboard 14 to display the notes or chords to be played when the strings(not shown in this Figure) contact the frets 16. The frets 16 are connected to the selector switches 104 and to the main board 88 by wires 136 via the PCB 112.

Figures 9, 10, 11, 12:
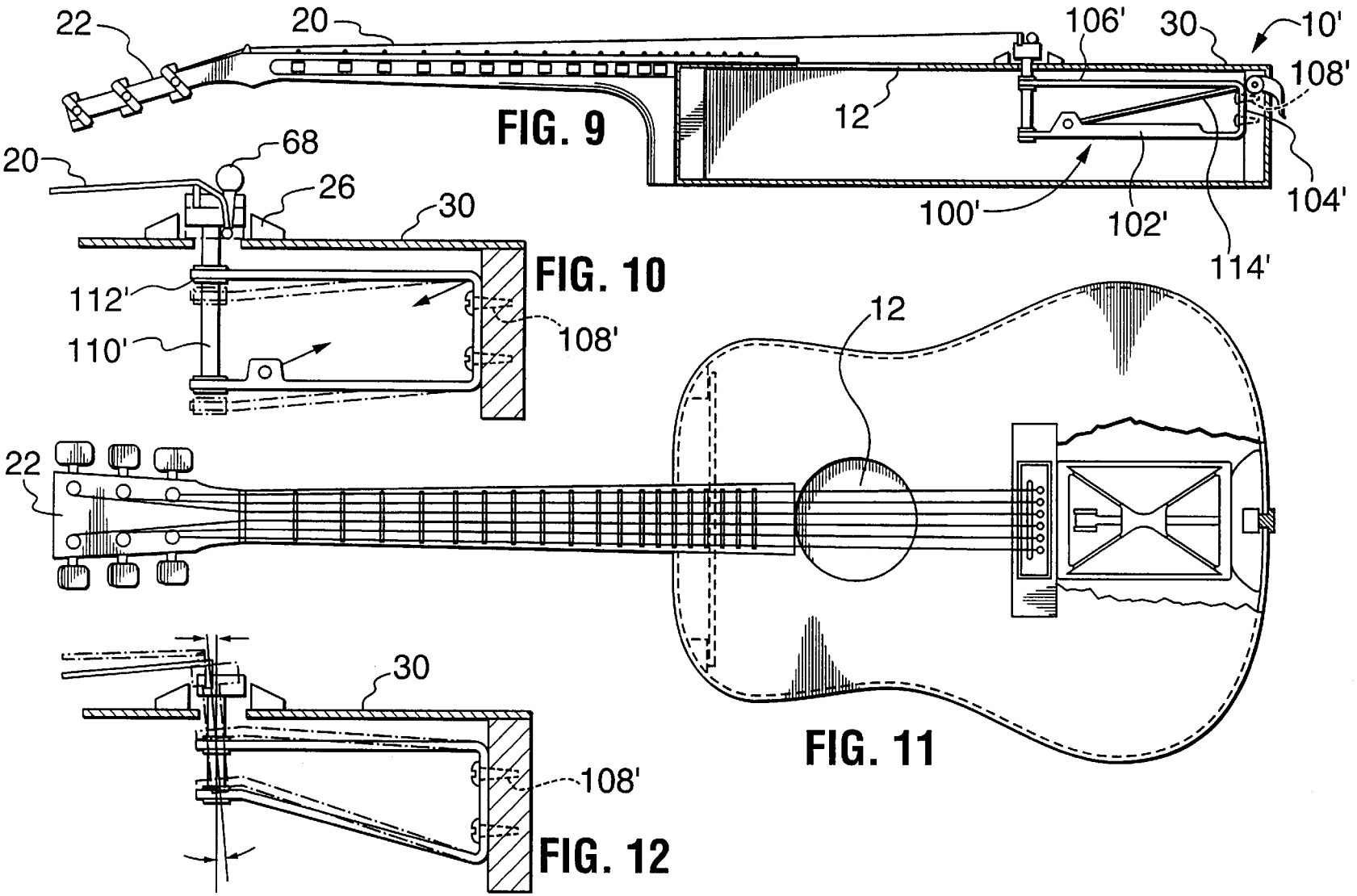
FIG. 9 illustrates a cross section of one embodiment with an internal tail piece.
FIG. 10 illustrates an enlarged view of the tail piece with parallel arms.
FIG. 11 illustrates a top view of the preferred embodiment with a portion of the sound board removed for clarity.
FIG. 12 illustrates the mechanism of string tension releasing by an internal piece with unparallel arms.
Figure 9A:
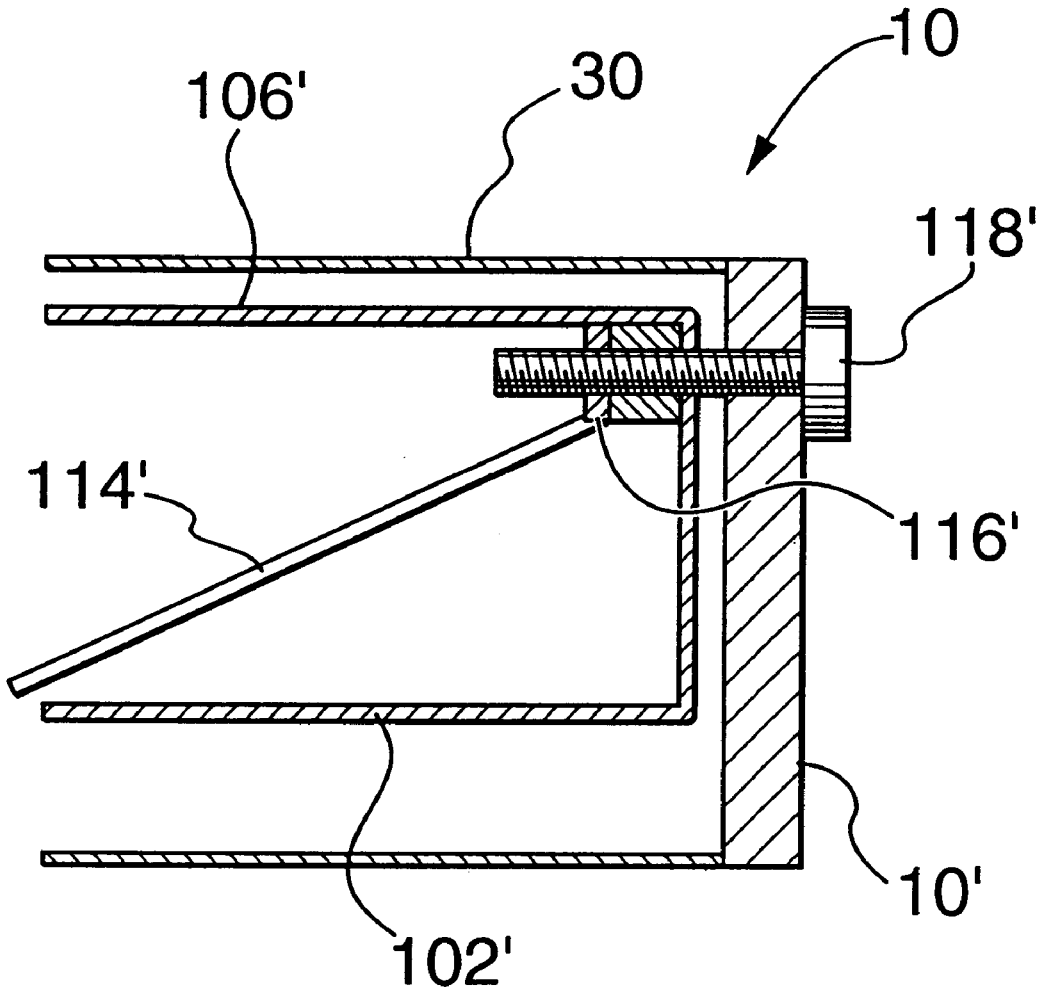
FIG. 9*a* illustrates an enlarged view of the tail piece in a further embodiment.

In a further embodiment of the invention, illustrated in FIG. 9 through 13, there is provided a U-shaped tail piece 100' suitable for disengaging the strings 20 from the sound board 30 mounted within guitar body 10. The tail piece 100' provides a resiliently deformable long arm 102', a base 104' and a further arm 106'. Base 104' is fastened by fasteners 108' to a rear internal support block 10' of body 10. A vertical strut 110' is fixedly mounted to an end of arm 102' and is mounted for selective slidable movement through a guide 112' connected at a terminal end of arm 106'. Strut 110' may be frictionally retained in a position selected (FIG. 10) where the strings 20 are free of sound board 30 or alternatively, a selectively engageable lock (FIG. 9*a*) may be employed. In FIG. 9*a*, a diagonal brace member 114' is shown clearly with parts of the tail piece 100' removed for purposes of clarity. The brace member 114' is pivotally connected at one end to arm 102' and in the embodiment of FIG. 9*a*, the opposed end threaded nut 116' to receive a blot member 118' thereon. Bolt member 118' extends through support block 10' and when turned either moves nut 116' towards or away from block 10'. This motion, in turn, is transmitted to brace member 114' which urges strut 110' up or down as the case may be. FIG. 13 illustrates that string tension may be lowered simultaneously with lifting the bridge 26. When the bridge 26 is lifted, the vibration of the strings 20 is not sensed by soundboard 30 and the feedback between string vibration sensing means (pick-ups) (not shown) and an output means, piezo activated soundboard (not shown) can be greatly reduced.

Figure 4:
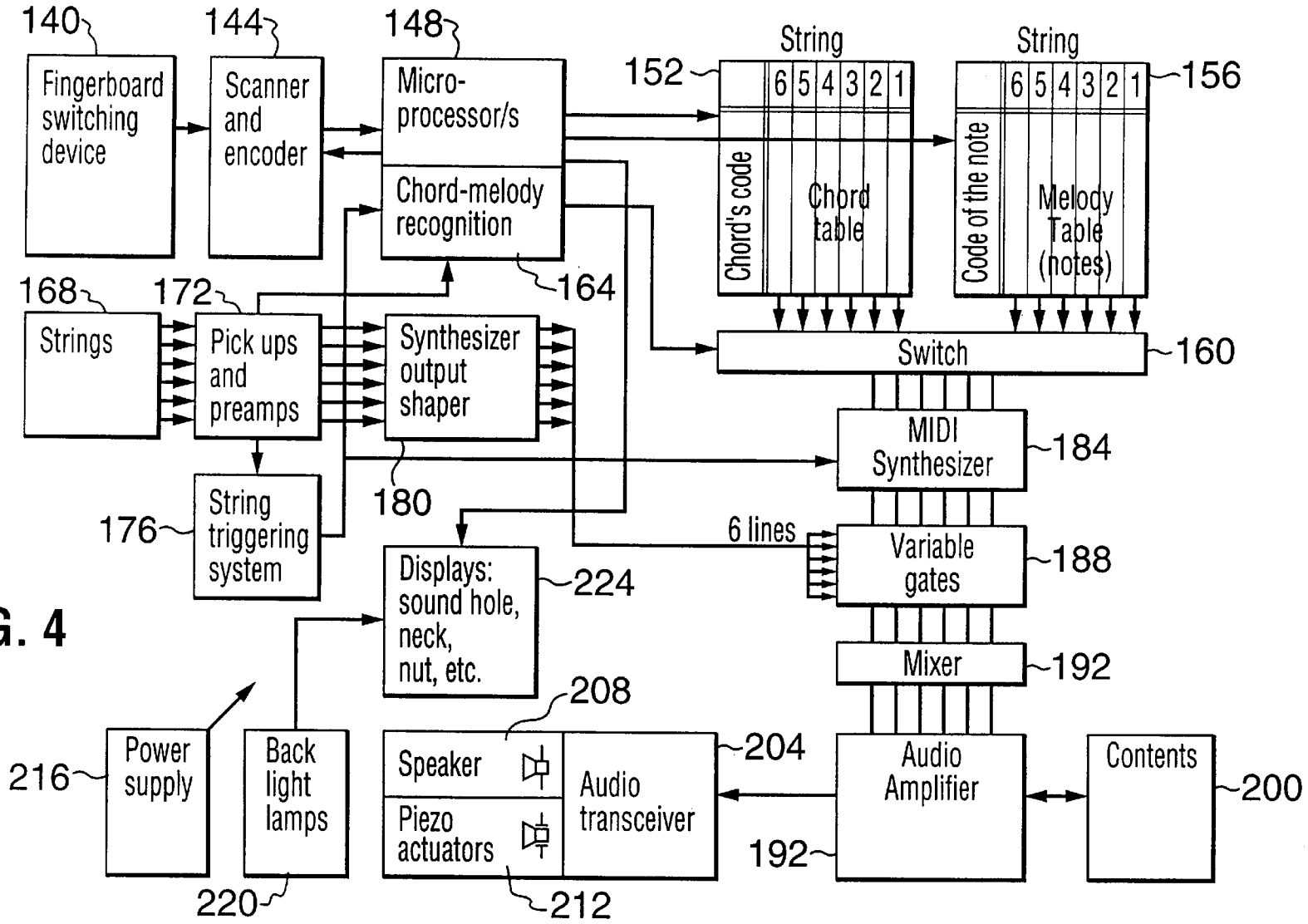
FIG. 4 illustrates a block diagram of the device.

FIG. 4 illustrates a block diagram of the overall system. The fingerboard switching device is represented by numeral 140 and communicates with a scanner and encoder circuit 144. Microprocessor 148 receives signals from these and communicates with chord 152 and melody 156 tables. The tables 152 and 156 are switchable by switch 160, the latter operable with a chord-melody recognition device 164 associated with microprocessor 148. The strings block 168 has the signals picked up by pick ups block 172 also in connection with block 164 and string trigger system 176. A synthesizer shaper 180, shapes the signals from block 172 and the signals are further shaped by a synthesizer 184 and 188. A mixer block 192 is provided and connects an amplifier 196 which, in turn, is modifiable by control block 200. A transducer 204 translates the signal into an audible signal by speaker 208 or piezo elements 212. The power supply block 216 provides the requisite power to the system and for the lamps 220, displays 224 etc.

In greater detail with respect to the string triggering systems according to the present invention, FIGS. 25 through 30 illustrate various embodiments for the trigger systems. Regarding FIG. 25, the embodiment illustrated provides solid frets 16 and strings 20. The signals from interactive between the frets 16 and strings 20 are forwarded to a fret scanner shown in FIG. 4 as element 144. Regarding FIG. 26, this embodiment provides for the segmented frets 16, previously referenced with respect to the discussion for FIG. 17*a*. For the segmented frets 16, a plurality of individual diodes 210 are provided with the signals being forwarded to scanner 144 in a similar manner to that set forth with respect to FIG. 25.

Figure 27:
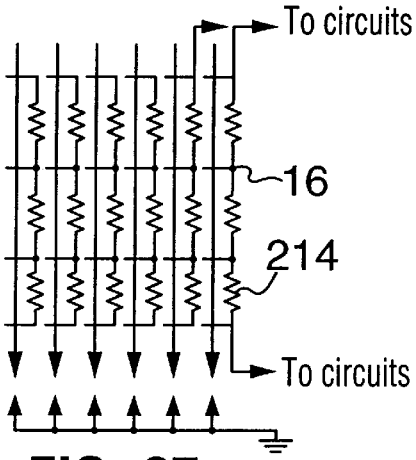
Figure 28:
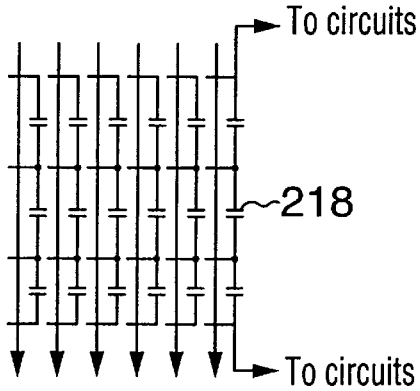
Figure 29:
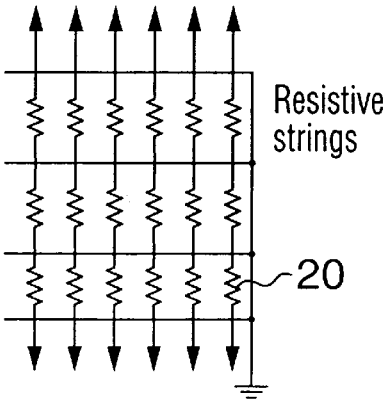
Figure 30:
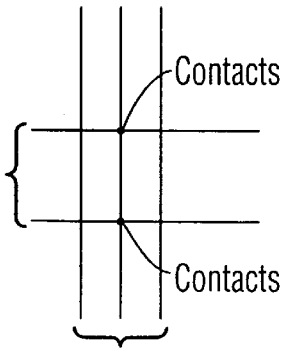

FIG. 27 sets forth a further embodiment for the string signal formation between the frets 16 and the strings 20. In this embodiment, the frets 16 provide for a plurality of individual resistors 214. FIG. 28 provides a further variation where the resistors 214 of FIG. 27 are replaced with capacitors 218. FIG. 29 illustrates a string and fret system where the strings 20 are resistive strings 20. With respect to FIG. 30, shown is a string making contact with two frets when depressed.

Figure 31:
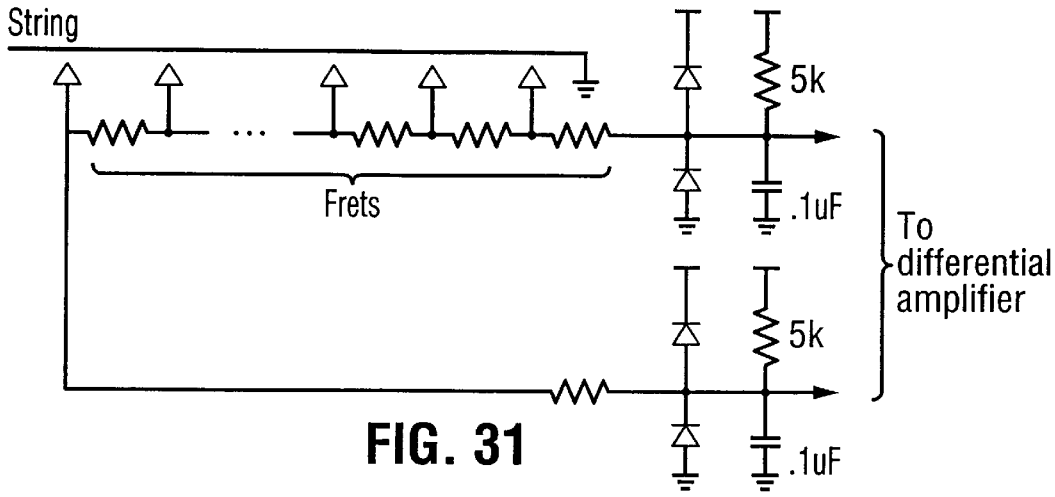
FIG. 31 illustrates a schematic finger position recognition circuit with a resistor ladder between frets.
Figure 32:
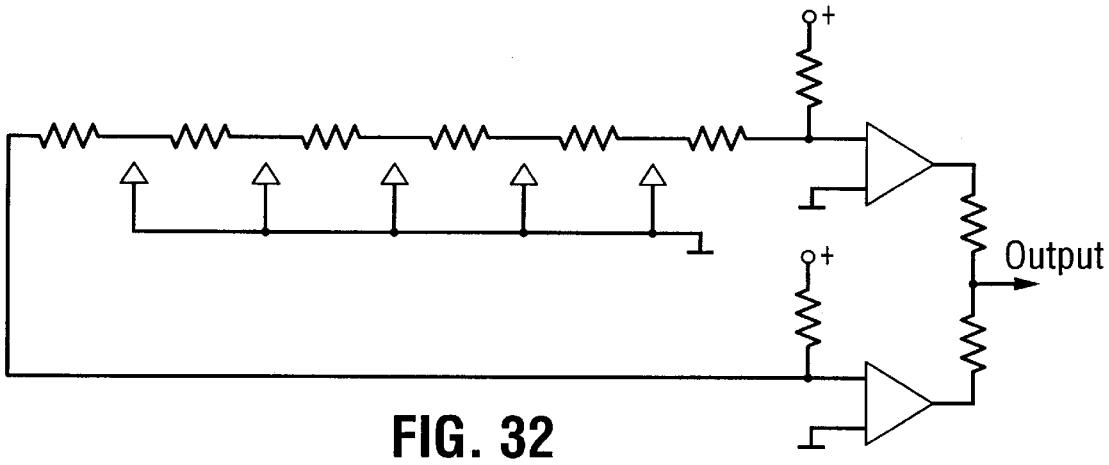
FIG. 32 illustrates a schematic finger position recognition circuit with electro conductive resistive strings.

FIGS. 31 and 32 more clearly illustrate the resistors 214 between the strings 20 and the disposition of the resistors 214 relative to the frets 16. FIG. 31 illustrates the schematic diagram for the circuit and references the capacitor and resistor tolerances. FIG. 32 similarly illustrates a schematic diagram showing the circuit for the resistive strings 20 referenced in FIG. 29.

Figure 33:
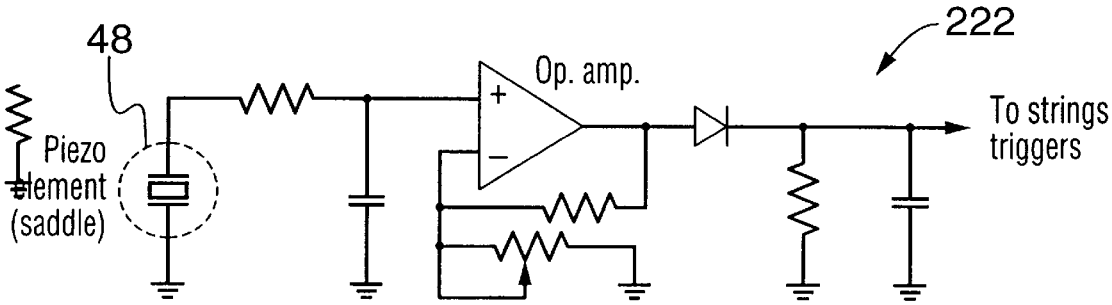
FIG. 33 illustrates a schematic diagram of the piezo pick up pre-amplifier.

Turning now to FIG. 33, and with additional reference to FIG. 14, the circuit diagram 222 for the piezo element bearing saddle 48 is illustrated. The circuit 222 provides a conventional resistor capacitor sequence with an operational amplifier and diode. This circuit 222 functions as a pre-amplifier for signals eventually forwarded to the trigger system 176, shown in FIG. 4.

Figure 34:
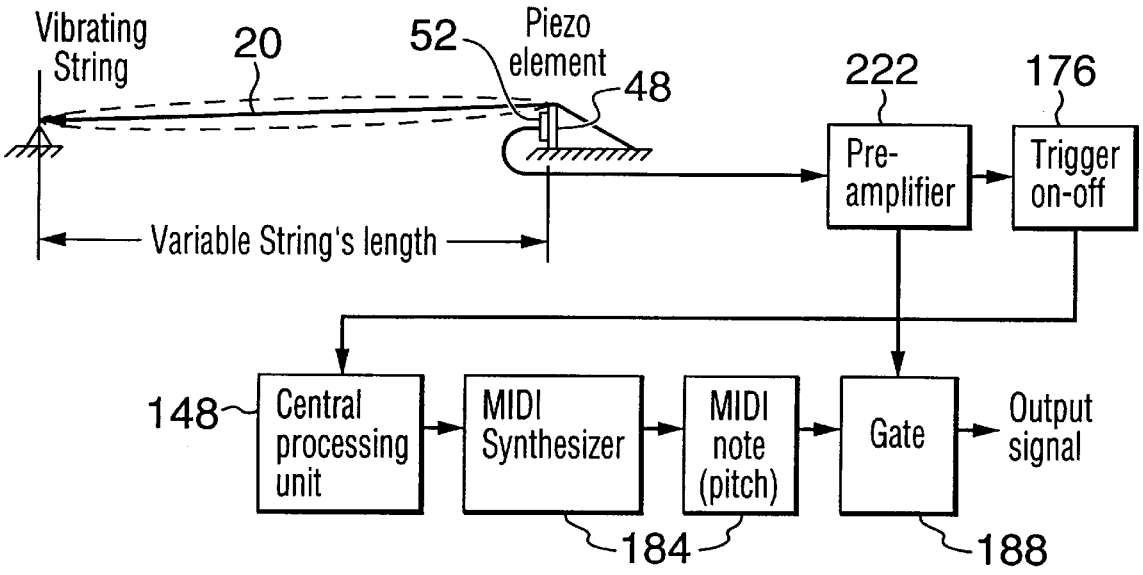
FIG. 34 illustrates the method of MIDI synthesizer output signal shaping by a real oscillating string.

FIG. 34 provides a schematic illustration of the MIDI note envelope former. The illustration shows the string 20, the piezo element 52 positioned on saddle 48. Signals received from the piezo element 52 are transmitted to the pre-amplifier circuit 222 referenced in FIG. 39 and passed to the trigger circuit 176. These signals are transmitted to the central processing unit 148 and the MIDI synthesizer 184. The signals are subsequently passed to gate 188 and finally, as an output.

Figure 35:
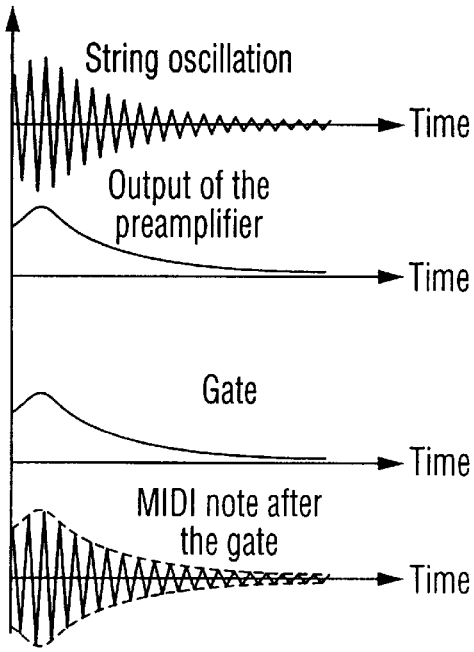
FIG. 35 illustrates a diagram of the MIDI note shaping.
Figure 36:
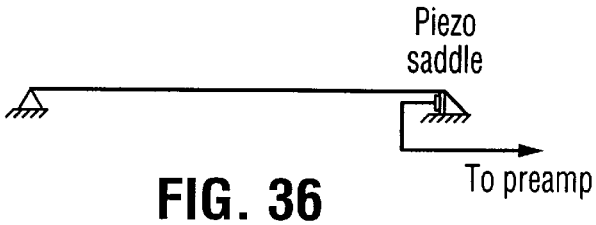
FIGS. 36 through 38, schematically illustrate a string triggering algorithm.
Figure 38:
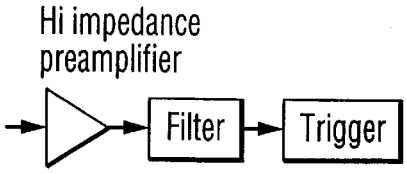
Figure 37:
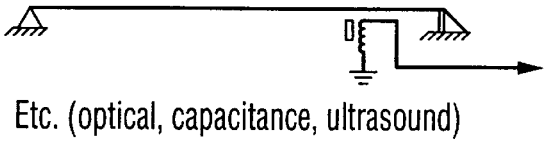

FIG. 35 illustrates a series of graphical representations of time as a function of output for the string oscillations. The figure depicts the envelope of string oscillations as a function of time and as an output of the pre-amplifier circuit 222. In the illustration, the output is shown as a rising curve which slowly decays over time; also illustrated gate 188 output as a function of time together with the formation of the MIDI note as a function of time having passed through the gate circuit 188.

Figure 39:
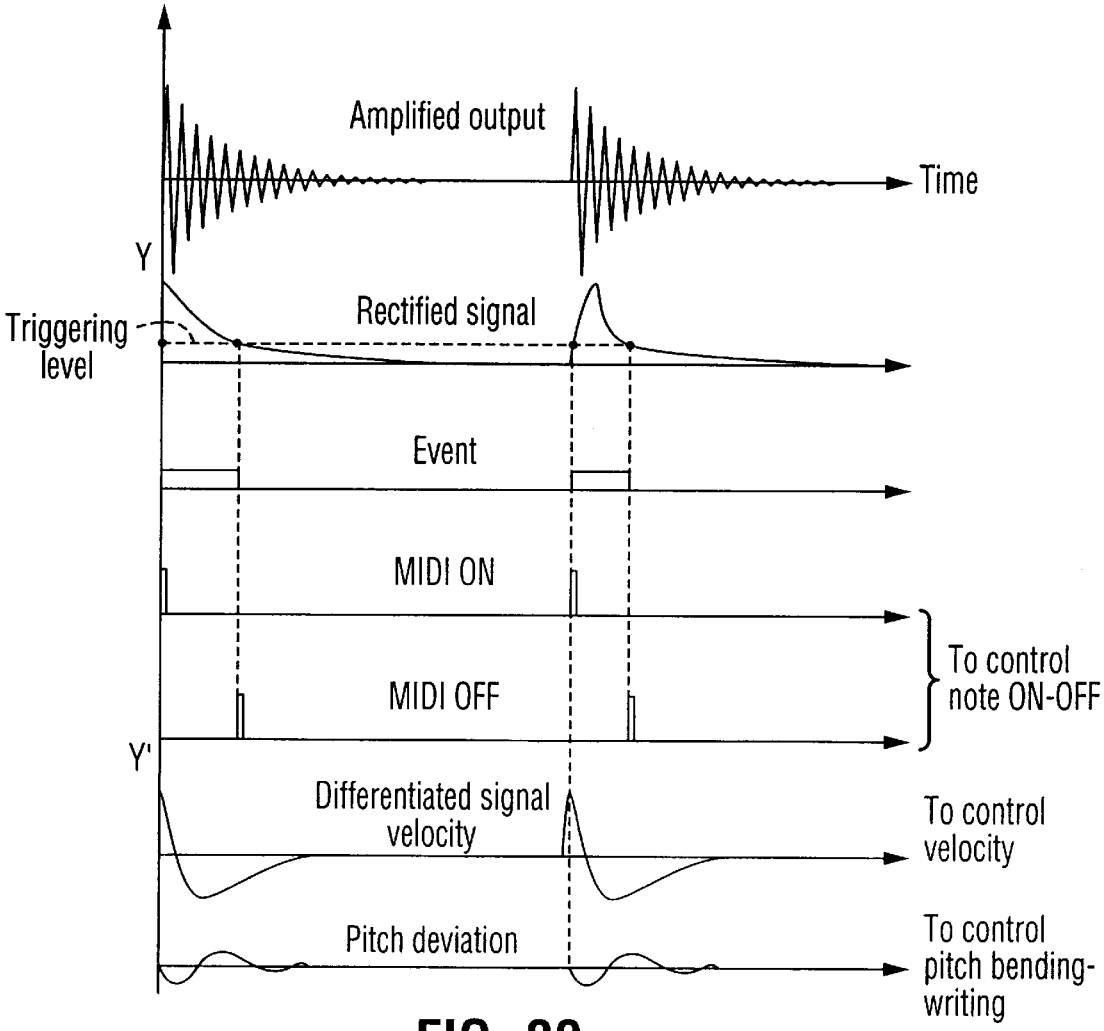
FIG. 39 illustrates algorithm of note ON and OFF generation, pitch bending and velocity of the note.

FIG. 39 shows a sequence of graphical representations of amplified output as a function of time for a rectified signal, event, the MIDI on and the MIDI off, differentiated signal velocity and pitch deviation.

Figure 40:
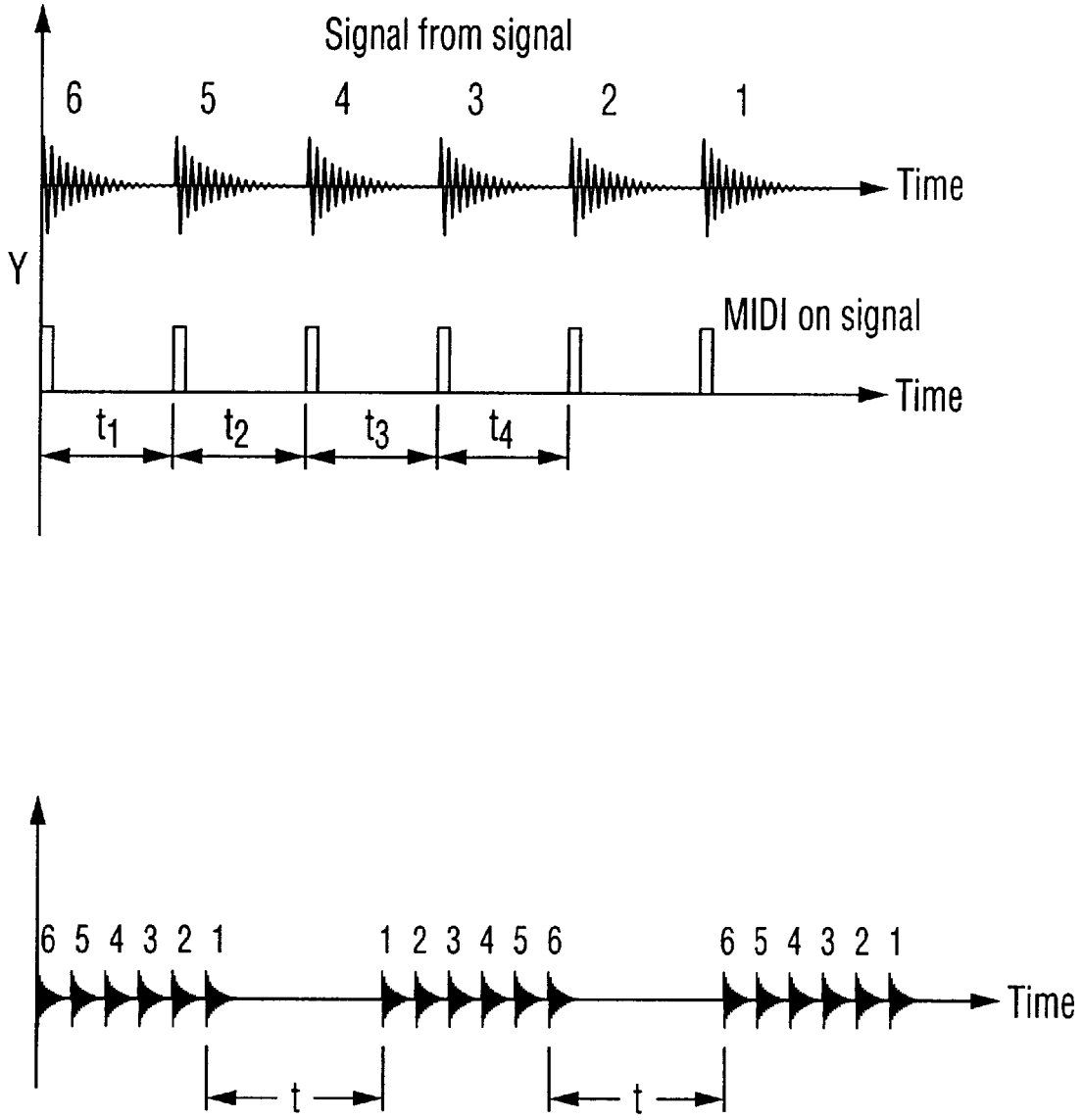
FIG. 40 is a schematic illustration of a detailed algorithm of switching between a melody and chord mode.

FIG. 40 provides two graphical illustrations where the chord recognition system is illustrated. In this specification, the strings have been previously referenced as strings 1 through 6. String 1 is the lowermost string on the guitar in its disposition as it would be played by a user. String 6 is the uppermost string. FIG. 40 shows signal amplitude as a function of time for strings 6 through 1 and corresponding time frames for the corresponding MIDI signals.

The chord recognition system employs mathematical algorithms examples of which include the following for a downstroke.

EXAMPLE 1

If $t_1$ is $<t$ then a chord is generated for the rest of the strings where t is a specified time frame. If $t_1$ is approximately the same as $t_2$ then a chord is generated for the rest of the strings. If t is $\leqq t_{delay}$ then the upstroke is recognized as a chord. If t is $>t_{delay}$ the guitar is converted into a melody mode and awaits instructions from low strings 6, 5, etc.

The melody recognition system of the instant invention is based on the algorithm that unless the chord mode is recognized by the sequence of strings strung, at least string numbers 1 through 5 or other specified strings are in a melody mode. FIGS. 36 through 40 illustrate algorithms.

Having generally delineated the overall circuitry and elements of the invention, reference to greater detail of the elements will now be made.

With respect to the trigger circuitry 176, due to the complexity of this component, two parallel solutions for note On and Off detection were employed. Signals from the pick up were either buffered and sent directly to an analog input on the central microprocessor element 88 (FIG. 13 and block 148, FIG. 4), or processed with analog circuitry designed to extract trigger (note On) and note Off information from the signal of a plucked string 20, then routed to analog inputs (not shown) on the central processor 88. LEDs 128 for each string indicate chord roots. The display may be made of transparent material such as PVC, glass, etc., and its shape chosen in such a way that it will direct the light from the LEDs toward the player.

The guitar is a chord-oriented guitar and pressing a single finger onto one fret 16 selects a diatonic chord from one of six families; two fingers selects the accidentals or chord modifiers; and a third finger may select one of six or eight variations on each chord. Additional operating modes programmed and accessible by depressing switches 104 allow for ornamentation of chords with melody notes, bass notes, or operation as a standard (electronic) guitar. Like a normal guitar, fretting selects notes or chords that strumming or plucking will sound.

In use, notes are played by strumming or plucking the strings 20. Each string 20 has a note it will play, determined by the current chord or note in a melody mode. The chord is set by pressing one or more fingers onto finger positions (fingering). Optionally, cords may be "sticky" i.e. chords that sustain (the default mode). In this case, the chord is stored and will continue to sound until the next chord is fingered.

The instrument senses frets, but a player normally puts the fingers between frets. It is referred to as finger position or fingering. On a normal guitar, the fret closer to the guitar body determines the length of the string and its pitch. In the case of the present invention, both the left and right frets are important. The instrument senses electrical contact between a fret 16 and a string 20 (FIG. 30). When a single finger presses a string 20, two frets 16 should make contact with that string 20. At the ends of the string, there is only a single fret to contact. This is compensated by software.

When two fingers pass a string, the two frets 16 surrounding each finger should make contact, but also any or all of the frets in between may make contact. Thus, at most only two fingers can be reliably detected on one string 20.

Chords are stored in the memory of the processor 88 as six notes, one for each string 20, and an optional seventh note for bass notes. Twelve chords are distributed along the guitar neck, for each harmonic pitch in an octave. The chords may repeat along the neck or they can belong to two octaves of chords. The current chord may be displayed in the sound hole. The basic note names for each finger position are displayed along the neck in the neck display.

There are two possible algorithms of chord distribution. The first option is to store all possible chords in the complete chord table 152 and play it back in a sequence determined by strumming or plucking strings on a current fingering. Another option is to use chord generation from the root chords using the chord map. In this case, the 12 chords are typically generated from 5 root chords, using a chord map. Chord maps 1,2,3,4,5,6 and 12 root chords are preprogrammed.

Each string 20 has a different family of chords assigned to it. In the standard chord table, the strings may have the following chord families:

1. Major
2. 7th
3. Minor 7th
4. Minor
5. 7th Altered
6. Minor 7th flat 5

Pressing a second finger selects one of several modified versions of the basic chord. For instance, there may be 8 modifiers per chord, currently arranged as:

| Fret | n | n+1 | n+2 | n+3 |
|---|---|---|---|---|
| string: m | root | acc | mod1 | mod2 |
| m+1 | solo | mod3 | mod4 | mod5 |
| m+2 | exit | mod6 | mod7 | mod8 |

Several arrangements of the chords in an octave are possible. Currently, the 7 notes of a diatonic scale are repeated along the neck, as C, D, E, F, G, A, B, as if they were the white notes on a piano. Another option is to use the so-called "cycle 5" system, where the 12 notes of an harmonic scale were arranged as F, C, G, D, A, E, B, Gb, Db, Ab, Eb, Bb or C, C♯/Db, D, D♯/Eb, E, F, F♯/Gb, G, G♯/Ab, A, A♯/Bb, B, etc. With the current arrangement, a diatonic scale occupies 7 finger positions, but the accidentals (harmonic notes that aren't diatonic) are not present. To reach those notes, two adjacent finger positions are pressed simultaneously, (in analogy with the black notes on a piano). Note that mod1 and mod2 cannot modify an accidental.

In a solo mode, single notes may be played along with chords, so that melodies can be played. One option is that single notes are played for example on strings 1 and 2. When no finger is down on a solo note string, the appropriate chord note will be played by that string. Solo mode is entered by pressing a root (plus accidental and modifier, if desired) and the same position on the next string. One exits the solo mode by pressing a root (plus accidental and modifier, if desired) and the same position on the second string over.

A further option, is that any string 20, except the 6th, can be played in melody mode and, switching to chord mode is produced when the strings are strummed downward, starting from the 6th string. In this case, the 6th string always produces the note as a part of the chord determined by the finger position and, the rest of the strings are reassigned to that chord as soon as the 6th string is strummed.

The microprocessor 88 analyzes the time delay between trigger events coming out of two or more strings 20 and, if that time is less than some predetermined level, the strings 20 are reassigned to chords.

In order to allow a player to continue with down and up strokes while playing the chords, the high strings (1–5) are kept in a chord mode for a specific time after a down stroke. After that time elapses or when all strings are muted, (no trigger events from the strings) the high string automatically switches to a melody mode.

One of the modes is that all strings are in a melody mode and produce the notes determined by a normal guitar fingering. The strings themselves can be out of tune, but the synthesizer will produce proper pitches. With respect to keys, any key can be selected on the instrument. By default, the key of C or E, for example, is selected. Pressing any finger position on string 1, and the same position for example on string 5, puts the selected note closer to the nut and displays the notes along the neck. Pressing any finger position on string 1, and the same position for example on string 6, puts the selected note closer to the nut but does not change the display of notes along the neck.

Settings are made by pressing the next to last finger position on a string, or switches placed between strings. There are 6 main setting type available.

A capo can be set in a manner similar to an actual guitar, by pressing for example the last finger position on string 6 and any finger position except the last one or may be set by an electro mechanical switch or selector.

A further mode is the solo guitar mode. In guitar mode, solo guitar mode, or on any string assigned as a guitar string, fretting behaves as on a conventional guitar, allowing normal guitar fingering and play, including hammer-downs for sounding strings. In guitar mode, open strings are also playable.

An example of chord tables is given below:

```
&5
=1 {
C: G2 C3 E3 G3 C4 E4. C3|maj
G: G2 B3 D3 G3 B4 G4. G2
D: D2 A3 D3 A4 D4 F#4. D2
A: E2 A3 E3 A4 C#4 E4. A3
E: E2 B3 E3 G#3 B4 E4. E2
}
=1 +1 {
C: G2 C3 D3 G3 C4 D4 |sus2
G: G2 C3 D3 G3 A4 G4
D: D2 A3 D3 A4 D4 E4
A: E2 A3 E3 A4 B4 E4
E: E2 B3 E3 F#3 B4 E4
}
&5
=1 +2{
C: G2 C3 F3 G3 C4 F4|sus4
G: G2 C3 D3 G3 C4 G4
D: D2 A3 D3 A4 D4 G4
A: E2 A3 E3 A4 D4 E4
E: E2 B3 E3 A4 B4 E4
}
&5
=1 +3 {
C: G2 C3 F#3 G3 C4 F#4|#4
G: G2 C#3 D3 G3 C#4 G4
D: D2 A3 D3 A4 D4 G#4
A: E2 A3 E3 A4 D#4 E4
E: E2 B3 E3 A#4 B4 E4
}
&5
=1 +4 {
C: G2 C3 G3 G3 C4 G4|no3
G: G2 D3 D3 G3 D4 G4
D: D2 A3 D3 A4 D4 A5
A: E2 A3 E3 A4 E4 E4
E: E2 B3 E3 B4 B4 E4
}
&5
=1 +5 {
C: G#2 C3 E3 G#3 C4 E4|aug
G: G2 B3 D#3 G3 B4 G4
D: D2 A#3 D3 A#4 D4 F#4
A: F2 A3 F3 A4 C#4 F4
E: E2 C3 E3 G3 C4 E4
}
=1 +6{
C: G2 C3 E3 A4 C4 G4|6
G: G2 D3 G3 B4 E4 G4
D: D2 A3 D3 A4 B4 F#4
A: E2 A3 E3 A4 C#4 F#4
E: E2 B3 E3 G#3 C#4 G#4
}
&5
=1 +7{
C: G2 C3 E3 G3 B4 E4|maj7
G: G2 B3 D3 G3 B4 F#4
D: D2 A3 D3 A4 C#4 F#4
A: E2 A3 E3 G#3 C#4 E4
E: E2 B3 D#3 G#3 B4 E4
}
&5
=1 +8{
C: G2 C3 G3 B4 C4 F#4|maj9(#11)
G: G2 D3 G3 A4 C#4 F#4
D: D2 A3 E3 A4 C#4 G#4
A: E2 A3 G#3 B4 C#4 G#4
E: E2 D#3 G#3 B4 F#4 A#5
}
&5
=2{
C: G2 C3 E3 A#4 C4 E4. C3|7
G: G2 B3 D3 G3 B4 F4. G2
D: D2 A3 D3 A4 C4 F#4. D2
A: E2 A3 E3 G3 C#4 E4. A3
E: E2 B3 D3 G#3 B4 E4. E2
```

-continued

```
}75
=2 +1{
C: G2 C3 D3 G3 C4 D4|sus2
G: G2 C3 D3 G3 A4 G4
D: D2 A3 D3 A4 D4 E4
A: E2 A3 E3 A4 B4 E4
E: E2 B3 E3 F#3 B4 E4
}
&5
=2 +8{
C: G2 A#3 E3 A4 D4 F#4|9(#11,13)
G: G2 A#3 F3 A4 C#4 E4
D: D2 E3 F#3 B4 C4 G#4
A: E2 C#3 G3 B4 D#4 F#4
E: F2 D3 G#3 A#4 C#4 F#4
}
&5
=3{
C: G2 C3 D#3 A#4 C4 D#4. C3|min7
G: G2 A#3 F3 A#4 D4 F4. G2
D: D2 A3 D3 A4 C4 F4. D2
A: E2 A3 E3 G3 C4 E4. A3
E: E2 B3 D3 G3 B4 E4. E2
}
&5
=6 +8{
C: G2 C3 D#3 A#4 D4 F#4|min9b5
G: G2 A#3 C#3 A4 D4 F4
D: D2 G#2 E3 A4 C4 F4
A: D#2 G#2 G3 B4 C4 E4
E: D#2 C#3 E3 G3 A#4 F#4
}
```

Note: & indicates string, = fret and + number of modifier.

The timer ISR provides a general heartbeat to the instrument, keeping track of the elapsed time, and triggering required IO actions. It operates as quickly as the fastest action, which is expected to, be the ADC for String Triggering, at 1000 . . . 4000 samples/sec for each of the 6 strings. The timer runs at a fixed rate. The various actions it controls happen at submultiples of that rate.

The ADC on the HC16 has eight inputs. It is expected that six of these will be used as String Trigger inputs, from the Piezo string sensors. The other two would go to 28-input analog multiplexers, to provide six pairs of inputs for resistive fret sensing, and four remaining inputs for Whammy and MIDI volume control.

The present invention is made in a form of an acoustic or solid body electric guitar with some custom features: a raised action at the nut and an optional internal tail piece for an acoustic version, wiring for the frets, grooves to hold the neck displays and nut LEDs, and a cutout through which to install the battery compartment and control panel. It is expected that the guitar will have 18 to 19 active frets.

The slightly raised action is improving necessary for sensing two fingers down on a string with wired frets. On a normal guitar, in order to reduce the amount of pressure needed to hold a string against a fret, the strings are kept as close as possible to the fret board at the nut end, but raised at the bridge so that the vibrating strings will not vibrate against the frets between the pressed fret and the bridge. In order to properly sense two fingers down on a string, a raised nut and increased pressure is needed to hold a string against a fret in order to ensure that the string will not touch any extra frets in either direction.

As an alternative, each string could act as a fibre-optic waveguide. When pressed against a (transparent plastic) fret, some of the light would leak across the boundary because of the similar refractive indices of the string and fret. That light would be detected as a fret press. To operate in the presence of ambient light, a code signal or infrared/ultraviolet light source with filters could be used.

Functional Description of the Operation

When the guitar is turned on, it opens in the guitar "default" mode. "Default" simply means that the instrument opens with the same set of preselected conditions every time it is turned on. The guitar has a choice of five different modes with the guitar mode chosen as the default mode. The diatonic scale using the standard "do re mi scale" has been chosen as the default scale. The key of "C" (DO) has been chosen as the default key and has automatically been installed in the (8th) master fret. The master fret 16 is situated approximately in the middle of the neck. It serves as a kind of roundhouse where different keys rotate according to need. There are seven frets to its left, and twelve to its right. The last fret, the nineteenth, is used exclusively for switching between different modes, leaving eighteen frets for musical performance purposes. The neck display 128 accommodates fourteen root chord symbols beginning from the left extreme of the neck, to where the neck meets the body. In the default mode, the neck display will look like this:

C D E F G A B *C* D E F G A B *C D E F*

The master fret is indicated by *C* (in italics), and the symbols *C D E F* (also in italics) represent the frets above where the neck meets the body. Though the root chord symbols C D E F (frets 15 to 18) do not appear on the neck display, they are active frets nonetheless, and one can use them as one would any other fret. If one ever forgets what the root chord symbols are, they have only to remember that they are the same as the first four root chord symbols on the neck display, starting with the master fret. This holds true no matter what key one is in. The eighth fret will indicate the default key of "C".

For those familiar with the DO RE MI system, the following is the equivalent in the A B C system.

| | | | | | | |
|---|---|---|---|---|---|---|
| C=DO | D=RE | E=MI | F=FA | G=SOL | A=LA | B=SI |

Normally, a chord symbol that has no indication as to whether it is major or minor is meant to be understood as being a major chord. Example: "F", "C", "F♯" etc., are all Major chords. A capital "M" is used to indicate Major chords for which the abbreviation is Major M. A lower case "m" is used for minor chords, for which the abbreviation is min or m. Sharps ♯ raise the pitch of a note by a semitone, and flats ♭ lower the pitch by a semitone. 3/4 means three (3) beats to the measure, 4/4 means four (4) beats to the measure.

In order to play chords on the guitar one has only to depress any individual string 20 in any fret and then strum away. One can finger-pick, but will probably get better results with a pick because of being more certain of strumming all of the six strings.

Though one can play in any key one chooses, it will be much easier to play in the key that has been installed in the master fret. As stated earlier, the default key on the guitar is the key of "C", but one can install any of the twelve keys of the chromatic scale in the master fret. One of the several advantages of installing a key (root chord) in the master fret is that no matter what key one chooses to play in the relative positions of the chords and fingering will always be the same. The key of "C", the guitar default key, is considered to be the easiest to play in because there are no sharps or flats in this key. When one installs a key, any key, in the master fret, it will always be as though they were playing in the key of "C". In other words, the fingering for playing in "G♭", "C♯", "A♭", "F", or any other of the twelve keys, is exactly the same as that of playing in the key of "C". One will never have to modify their fingering in order to accommodate any number of sharps or flats in any key or scale. The guitar microprocessor performs this function. In the default mode, the neck display indicates where seven of the twelve chord roots (keys) are located, C, D, E, F, G, A, and B. These seven keys are the ones that are likely to be used most often. All of the twelve keys can be installed in the master fret using the same method as described below.

The installation into the master fret is accomplished in the following manner: momentarily depressing strings one and three within the same fret that is adjacent to the "A" symbol in the neck display. The key of "A" will now install itself in the master fret. The neck display will now show the diatonic "A" major scale: "A", "B", "C♯", "D", "E", "F♯", "G♯", "A". This is the key in which one will now be singing and playing. If one wants to return to the default key of "C", one has only to install it as described above, just as any other key.

There is only one reason to use the two step installation. It is to be able to read chord symbols in one key while actually playing in another. This need could arise where the key in which a piece of sheet music has been printed is not suitable to one's singing voice. The two step installation allows one to install the key in which the sheet music was printed, into the master fret so that one can read the chord symbols, but actually have the instrument play in a different key. This example uses the sheet music of Amazing Grace. The song is in 2♯ (sharps), the key of "D". The first of two steps is to install the key of "D" in the master fret exactly as described two paragraphs earlier. The neck display will now show the diatonic "D" major scale: "D", "E", "F♯", "G", "A", "B", "C♯", "D". Having done this, a more desirable key may be selected, described hereinafter. As an example, the key of "F" may be chosen. The second step, is to momentarily depress strings one and six within the same fret that is adjacent to the "F" symbol on the neck display. In this case, the key of "F" will maintain its original position on the neck display, but a dot will appear next to its symbol indicating that "F" is the active key. Though the master fret still indicates the key of "D", one actually be in their chosen key of "F". The result of all this, is that one will be able to read the chord symbols that were printed in the key of "D" on the sheet music but will be actually playing and singing the song in their chosen key of "F".

The following are the chord families as they appear at the end of the fingerboard, right next to the sound hole. Each chord family is assigned a particular string. If one is searching for particular chords, one can find them by using the guitar grid system. They only need to line up a root chord indicated on the neck display with one of the six chord families indicated at the end of the fingerboard, depress the string where the axes converge, and then strum. In FIG. 7, C minor $7^{th}$ is shown as an example of such a convergence. If one wants to be sure of the chord played, one only has to glance at the soundhole display. Once one depresses a string in order to obtain a chord, one doesn't have to hold it down. This is a tremendous advantage, as it allows one more time to position oneself for the upcoming chord, while continuing to strum the previous one.

| | |
|---|---|
| String 1. | Major chords |
| String 2. | 7th chords |
| String 3. | Minor 7th chords |
| String 4. | Minor chords |
| String 5. | 7th + Altered chords |
| String 6. | Minor 7b5 chords |
| C D E F G A B C D E F G A B C | |

When one depresses a root chord a light will come on in the nu/root indicator. This indicates the string which has the root note. This is the string one should play first if one is using the bottom strings as bass notes.

With one finger of the left hand, it has been possible to access six chords per note, that is, six different C chords, C Major, C $7^{th}$, C minor $7^{th}$, etc.), six different D chords, six different E chords and so on. By using two fingers of the left hand, one can access nine additional chords per root chord. In order to access these chords, one must depress and hold a root chord plus an additional fret position to the right of the root chord. These additional fret positions are called positive modifiers and the chords obtained through this process are called modified chords. The root chord must be depressed before the positive modifier, but only by a matter of milliseconds. The modified chords are available in conjunction with any root chord throughout the whole fingerboard with the exception of the last ($19^{th}$) fret. Since there are 12 tones in the music tonal system, and six strings on the guitar, it would require 72 different graphics to display the system entirely.

This graphic display uses R as a representative symbol for all the different root chords and is meant to show that the relationship of the modified chords to the root chords, whatever and wherever they are, are the same throughout the system.

The key signature (a number of sharps ♯ or flats ♭ and meter, 3/4, 4/4, etc.) is found in the first bar of sheet music. An easy way to determine whether a key signature indicates a major or minor key is by determining which appears more often; major or minor chords. With a key signature of two ♯♯ for instance, mostly "D" major chords are found. This indicates a key of "D". If mostly "B" minor chords are found, the key is "B" minor.

As previously stated, the chromatic deviations are always accessed in the same way. By depressing and holding down two adjacent frets on the same string which yield the chromatic deviation that is between them. Example: C & D=(C♯/D♭), D & E or D & E♭ (E or E♭) depending on the scale being used. Four different, scales are offered:

| | | |
|---|---|---|
| All Strings | THE CHROMATIC SCALE | string 1 is one octave (8va)higher than string 2 |
| Strings 1 & 2 | THE MAJOR SCALE | |
| Strings 3 & 4 | THE NATURAL | string 3 is one octave (8va) higher than string 4 |
| Strings 5 & 6 | THE HARMONIC MINOR SCALE | string 5 is one octave (8va) higher than string 6 |

In order to enter the melody mode, one must depress a root chord in conjunction with a neighboring string within the same fret. If one plucks the first string of the root chord it will play a single note. This note will be the tonic, (the keynote). Examples are: C for any "C" root chord, F for any "F" root chord etc. This will allow one to choose, and play a specific note upon entering the melody mode One can enter the melody mode in any of the scales offered, and the neck display will show the notes of the scale that is being played.

In the melody mode, the master ($8^{th}$) fret will flicker while the seven displays to its left, and the twelve displays to its right will remain stable. This table/flicker situation is exactly opposite of what is found in the guitar chord mode. This will always remind one as to which mode they are in.

The guitar offers two standard guitar modes, mode G1 and mode G2.

In mode G1, the guitar reverts to a standard guitar with the exception of the following:

1) the guitar sound is generated and amplified electronically;
2) the strings are in low tension; and,
3) the neck display, nut/root indicator, and sound hold display are still active.

Other than this the instrument behaves like a standard guitar. One must use standard guitar fingering to obtain chords and scales. In order to enter mode G1 one must simultaneously depress strings one and two of the nineteenth fret.

In mode G2, the guitar reverts to a standard guitar. Actuate the lever to deactivate the string damper. Next, one must tune the strings to E A D G B E. The guitar has a built-in standard guitar tuning aid. Depress strings one and four of the $19^{th}$ fret (last fret). This will put the instrument in tuning mode 2.

We claim:

1. A musical instrument, comprising:

an instrument body having strings mounted thereon;

string vibration sensing means for sensing vibration of said strings and creating an envelope of vibration of said strings;

a central processing unit;

an elongate fingerboard having a finger position recognition system for recognizing finger position;

memory means for storing preprogrammed notes and chords;

output means for transmitting vibration information from said memory means; circuit means connected to said output means, said string vibration sensing means, said central processing unit, said finger recognition system and said memory means for determining said envelope of vibration of said strings whereby note or chord intensity intended by a user is conveyed to transducer means; and analyzing means in said circuit means for analyzing string vibration for string velocity, status and sequence of notes played.

2. The musical instrument as set forth in claim 1, wherein said instrument body comprises a solid body guitar.

3. The musical instrument as set forth in claim 1, wherein said instrument body comprises a body with a sound board.

4. The musical instrument as set forth in claim 3, wherein said sound board is made of wood.

5. The musical instrument as set forth in claim 1, wherein said instrument body comprises an acoustic guitar.

6. The musical instrument as set forth in claim 1, wherein said instrument body comprises a classical guitar.

7. The musical instrument as set forth in claim 1, wherein said st ring vibration sensing means comprises piezo activated pick ups.

8. The musical instrument as set forth in claim 1, wherein said string vibration sensing means comprises optically activated pick ups.

9. The musical instrument as set forth in claim 1, wherein said string vibration sensing means comprises magnetically activated pick ups.

10. The musical instrument as set forth in claim 3, wherein said output means comprises an element selected from the group consisting of a piezo element, an audio speaker, external amplifier, headphones or an actuator connected to said sound board.

11. The musical instrument as set forth in claim 1, wherein said elongate fingerboard includes individual frets for sensing the position of a user's finger.

12. The musical instrument as set forth in claim 11, wherein said frets are wired frets.

13. The musical instrument as set forth in claim 11, wherein each fret has isolated segments corresponding to a string or group thereof.

14. The musical instrument as set forth in claim 1, wherein said strings are electro conductive.

15. The musical instrument as set forth in claim 1, wherein said instrument includes a self contained battery system.

16. The musical instrument as set forth in claim 2, wherein said guitar includes a neck, said neck having visual display means for displaying chords, notes or a root string to a user.

17. A guitar, comprising:

a body and fret board;

a plurality of electro conductive frets mounted to said fret board;

a plurality of electro conductive strings;

a string vibration sensing means for sensing vibration of said strings;

a central processing unit and memory means for storing preprogrammed chords or notes;

output means including a soundboard with at least one piezo electric activator means secured thereto;

circuit means connected to said string vibration sensing means, frets and said strings means for determining the position of user's finger on said fret board and accessing said memory means for a preprogrammed note or chord; and analyzing means in said circuit means for analyzing string vibration, string velocity, status and sequence of notes played for determining an envelope of vibration of said strings whereby note intensity and chord note sequence intended by a user is conveyed to said output means by playing notes from said memory means.

18. The guitar as set forth in claim 17, wherein said guitar has a neck, said neck having visual display means for at least one of said frets or strings for indicating finger position on said fret board.

19. The guitar as set forth in claim 18, wherein said display comprises one of an LCD, LED or an electro luminescent display.

20. The guitar as set forth in claim 18, wherein each fret and string includes said display means.

21. The guitar as set forth in claim 17, wherein said strings are mounted to a bridge, said bridge mounted adjacent a sound board.

22. The guitar as set forth in claim 21, further including bridge movement means for selectively moving said bridge relative to said sound board to reduce string vibration sensing.

23. The guitar as set forth in claim 22, wherein said bridge movement means includes a strut member mounted to said bridge and a deformable arm mounted to said strut member.

24. The guitar as set forth in claim 23, wherein said deformable arm is mounted internally of said body of said guitar for resilient deformation.

25. A method of electronically generating sound from a guitar, comprising the steps of:

providing a guitar including:

signal pick ups and a fret board;

memory means having sampled chords, notes or a chord map;

electro conductive strings and frets on said guitar; and finger position recognition means for recognizing finger positioning on said fret board;

analyzing string vibration for string velocity, status and sequence of notes played;

comparing said notes played with notes in said memory means;

determining said status and velocity of said strings;

forming a signal based on determined velocity and compared notes;

transmitting said signal to an output for audible execution of said signal.

26. The method as set forth in claim 25, wherein an envelope of said notes are formed by said determined velocity.

27. The method as set forth in claim 25, including forming a chord by activation of said electro conductive frets by at least one of said strings.

28. The method as set forth in claim 25, wherein said step of forming a signal includes amplifying said signal with amplifier means.

29. A musical instrument, comprising:

an instrument body having electro conductive strings mounted thereon and a sound board mounted thereto;

string vibration sensing means for sensing vibration of said strings and creating an envelope of vibration of said strings, a central processing unit; transducer means for transmitting vibration information from said string vibration sensing means to an output means;

a fret board having a plurality of electro conductive frets;

memory means for storing preprogrammed notes and chords;

fret board switching means for determining the position of a user's finger on said fret board and accessing said memory means for a preprogrammed note or chord; and circuit means connected to said transducer means and said fret board for determining the envelope of vibration of said strings whereby note or chord intensity intended by a user is conveyed to said transducer means said circuit means including ON/OFF signal analysis means for determining whether a string has been plucked, said signal analysis means comprising a rectified envelope of string vibration, said envelope of said vibration being processed by a low pass filter and diferentiator for producing said ON/OFF signal for a note and velocity of said note.

30. The musical instrument as set forth in claim 29, wherein said string vibration sensing means comprises a piezo-electric pick-up saddle.

* * * * *